US010272708B2

(12) United States Patent
Fujita et al.

(10) Patent No.: US 10,272,708 B2
(45) Date of Patent: Apr. 30, 2019

(54) THERMOSENSITIVE RECORDING MATERIAL AND METHOD FOR MANUFACTURING THE SAME

(71) Applicant: FUJIFILM CORPORATION, Minato-ku, Tokyo (JP)

(72) Inventors: Masayoshi Fujita, Shizuoka (JP); Yasuo Enatsu, Shizuoka (JP); Yoshihisa Hashi, Shizuoka (JP)

(73) Assignee: FUJIFILM CORPORATION, Tokyo (JP)

( * ) Notice: Subject to any disclaimer, the term of this patent is extended or adjusted under 35 U.S.C. 154(b) by 0 days.

(21) Appl. No.: 15/791,428

(22) Filed: Oct. 24, 2017

(65) Prior Publication Data

US 2018/0043717 A1 Feb. 15, 2018

Related U.S. Application Data

(63) Continuation of application No. PCT/JP2016/066070, filed on May 31, 2016.

(30) Foreign Application Priority Data

Jun. 1, 2015 (JP) ..... 2015-111763

(51) Int. Cl.

| | |
|---|---|
| ***B41M 5/44*** | (2006.01) |
| ***B41M 5/42*** | (2006.01) |
| ***B41M 5/28*** | (2006.01) |
| ***B41M 5/337*** | (2006.01) |

(52) U.S. Cl.

CPC ..... *B41M 5/42* (2013.01); *B41M 5/28* (2013.01); *B41M 5/3372* (2013.01); *B41M 5/44* (2013.01); *B41M 2205/04* (2013.01); *B41M 2205/40* (2013.01)

(58) Field of Classification Search

CPC ..... B41M 5/337; B41M 5/3372; B41M 5/42; B41M 5/44; B41M 2205/04; B41M 2205/40

USPC ..... 503/200, 214, 226; 427/150, 152

See application file for complete search history.

(56) References Cited

U.S. PATENT DOCUMENTS

| | | | | |
|---|---|---|---|---|
| 5,661,101 | A | 8/1997 | Washizu et al. | |
| 7,238,642 | B2 * | 7/2007 | Shimbo et al. | B41M 5/40 503/201 |
| 7,338,919 | B2 * | 3/2008 | Kawahara et al. | B41M 5/30 503/201 |
| 8,592,341 | B2 * | 11/2013 | Tsuchimura et al. | B41M 5/44 503/201 |
| 8,969,243 | B2 * | 3/2015 | Nahm | B41M 5/44 503/226 |
| 2005/0054527 | A1 | 3/2005 | Iwasaki et al. | |
| 2010/0048395 | A1 | 2/2010 | Ohga | |
| 2012/0238446 | A1 | 9/2012 | Tsuchimura et al. | |

FOREIGN PATENT DOCUMENTS

| | | | |
|---|---|---|---|
| CN | 102673212 | A | 9/2012 |
| EP | 1321306 | A2 | 6/2003 |
| JP | H09-66666 | A | 3/1997 |
| JP | H11-314458 | A | 11/1999 |
| JP | 2003-94826 | A | 4/2003 |
| JP | 2004-142227 | A | 5/2004 |
| JP | 2006-334927 | A | 12/2006 |
| JP | 2007-230151 | A | 9/2007 |
| JP | 2012-24994 | A | 2/2012 |
| WO | 2010/038864 | A1 | 4/2010 |

OTHER PUBLICATIONS

Extended European Search Report dated Jun. 5, 2018, issued in corresponding EP Patent Application No. 16803349.6.

International Search Report issued in International Application No. PCT/JP2016/066070 dated Jul. 26, 2016.

Written Opinion of the ISA issued in International Application No. PCT/JP2016/066070 dated Jul. 26, 2016.

English language translation of the following: Office action dated Aug. 10, 2018 from the SIPO in a Chinese patent application No. 201680026937.3 corresponding to the instant patent application. This office action translation is submitted now in order to supplement the understanding of the cited references which are being disclosed in the instant Information Disclosure Statement.

* cited by examiner

*Primary Examiner* — Bruce H Hess

(74) *Attorney, Agent, or Firm* — Solaris Intellectual Property Group, PLLC

(57) ABSTRACT

An embodiment of the present invention provides a thermosensitive recording material and a method for manufacturing the same. The thermosensitive recording material includes, on a support, a thermosensitive recording layer containing a polyvinyl alcohol and a color development component; and a protective layer containing a resin component, in this order from the support side. At least one of the thermosensitive recording layer or the protective layer further contains a styrene-isoprene resin.

14 Claims, No Drawings

THERMOSENSITIVE RECORDING MATERIAL AND METHOD FOR MANUFACTURING THE SAME

CROSS-REFERENCE TO RELATED APPLICATIONS

This application is a continuation application of International Application No. PCT/JP2016/066070, filed May 31, 2016, the disclosure of which is incorporated herein by reference in its entirety. Further, this application claims priority from Japanese Patent Application No. 2015-111763, filed Jun. 1, 2015, the disclosure of which is incorporated herein by reference in its entirety.

BACKGROUND OF THE INVENTION

1. Field of the Invention

The present disclosure relates to a thermosensitive recording material and a method for manufacturing the same.

2. Description of the Related Art

In the related art, a thermosensitive recording body using a color development reaction between a leuco dye using heat and a color developer which develops the leuco dye has been widely known. The thermosensitive recording body using such a color developing principle is relatively inexpensive, and a recording device is compact and relatively easy in maintenance. Therefore, the thermosensitive recording body is used not only as a recording medium of a facsimile machine, various calculators, or the like, but also as a recording medium of a plotter for an output printer of a medical image diagnostic device or the like.

Among them, in the thermosensitive recording body used as the recording medium that records an image in a medical image diagnostic device, a gradation image displayed by illuminating an object with Schaukasten is observed. Therefore, it is necessary to have excellent transparency and express an accurate recording density in an image area which has excellent transparency. Accordingly, the quality required for images is significantly high.

In a case of using a transparent thermosensitive recording material for medical use, high transmission density is required. Therefore, heat energy applied by a thermal head increases, and abrasion of the thermal head due to printing becomes a factor significantly impairing the quality of images. It is known that the abrasion of a thermal head promoted not only by simple mechanical abrasion with a thermosensitive recording material, but also by deterioration of a thermal head caused by oxidation or the like due to water or heat.

In addition, in some cases, a phenomenon (yellowing) may occur in which the color of an image changes to yellow by repeatedly exposing a thermosensitive recording body to Schaukasten. In some cases, the yellowing may disrupt diagnosis.

In order to prevent the abrasion of a thermal head described above, a protective layer containing a pigment, a lubricant, and a binder as main components is generally provided on a thermosensitive recording layer. In addition, in order to prevent the yellowing of an image, in some cases, a gas shielding layer, an undercoat layer, an ultraviolet filter layer, a light reflection prevention layer, and the like are provided on the thermosensitive recording layer in addition to the protective layer.

In order to improve water resistance of a protective layer, a thermosensitive recording body is proposed as a technique related to the above in which an acetoacetyl-modified polyvinyl alcohol is used as an adhesive component in the protective layer and a hydrazine compound is used as a water-resistant agent in the thermosensitive recording layer (for example, refer to JP1999-314458A (JP-H11-314458A)).

In addition, in order to prevent deterioration of transparency caused in a case where the thermosensitive recording layer and the protective layer which come into contact with each other are mixed (interfacially mixed) at a contact interface, an interlayer is proposed which contains a water-soluble resin as a main component between the thermosensitive recording layer and the protective layer (for example, refer to JP2003-94826A and WO2010/038864A).

In addition, a technique is also proposed in which a polymer latex containing a urethane resin component in an interlayer is used (for example, refer to WO2010/038864A).

SUMMARY OF THE INVENTION

Particularly, in the thermosensitive recording body used as a recording medium that records an image in a medical image diagnostic device, abrasion of a thermal head in a case of continuous printing, disconnection of a heater of a head accompanied by the abrasion, and yellowing of an image are hardly caused while favorable transparency is maintained.

However, satisfactory effects cannot be always obtained from the techniques for improving a protective layer or an interlayer as described above. In addition, in the technique in which a polymer latex containing an urethane resin component is used in an interlayer, a color development rate of a leuco coloring agent is controlled by a blocking reaction due to a separated isocyanate group, and it is necessary to increase the coating amount of the leuco coloring agent in order to obtain a desired density, which increases cost. Furthermore, the yellowing of an image which may cause a problem during diagnosis tends to deteriorate.

On the other hand, in a case where a water-soluble resin such as gelatin is contained as a binder in the interlayer instead of the polymer latex containing a urethane resin component, absorption of moisture is relatively large. Therefore, the absorbed moisture causes defects of promoting abrasion while oxidizing and degrading a thermal head due to water or heat, or increasing environmental humidity dependency of color development sensitivity.

The present disclosure has been made in consideration of the above. An object of the present disclosure is to provide a thermosensitive recording material which has excellent thermal color development properties and in which an occurrence of image defects such as white streaks is suppressed by suppressing deterioration of a thermal head, and a method for manufacturing the same, and the present disclosure aims to achieve the object.

Specific means for solving the problem includes the following aspects.

<1> A thermosensitive recording material comprising, on a support, a thermosensitive recording layer containing a polyvinyl alcohol and a color development component; and a protective layer containing a resin component, in this order from the support side, in which at least one of the thermosensitive recording layer or the protective layer further contains a styrene-isoprene resin.

<2> The thermosensitive recording material according to <1>, in which the resin component contained in the protective layer contains a polyvinyl alcohol.

<3> The thermosensitive recording material according to <1> or <2>, in which the styrene-isoprene resin has two glass transition points.

<4> The thermosensitive recording material according to <3>, in which the styrene-isoprene resin has a first glass transition point of 25° C. or lower and a second glass transition point of 50° C. or higher as the two glass transition points.

<5> The thermosensitive recording material according to <4>, in which the difference obtained by subtracting the first glass transition point from the second glass transition point exceeds 30° C.

<6> The thermosensitive recording material according to any one of <1> to <5>, in which a mass ratio of a structural unit St derived from styrene to a structural unit Ip derived from isoprene in the styrene-isoprene copolymer is 55:45 to 90:10.

<7> The thermosensitive recording material according to any one of <1> to <6>, in which a polyvinyl alcohol contained in at least the protective layer has an acetoacetyl group.

<8> The thermosensitive recording material according to any one of <1> to <7>, in which the styrene-isoprene resin is a copolymer including a structural unit derived from styrene, a structural unit derived from isoprene, and a structural unit derived from acrylic acid or methacrylic acid.

<9> The thermosensitive recording material according to any one of <1> to <8>, in which the color development component includes a first component that develops a color and a second component that causes the first component to develop a color, and at least the first component is encapsulated in a microcapsule.

<10> The thermosensitive recording material according to any one of <1> to <9>, in which the support is a polymer film.

<11> The thermosensitive recording material according to any one of <1> to <10>, further comprising at least one interlayer that contains a polyvinyl alcohol, between the thermosensitive recording layer and the protective layer.

<12> The thermosensitive recording material according to any one of <1> to <11>, in which, in each of the thermosensitive recording layer and the protective layer, the gelatin content is less than 10 mass % with respect to a total mass of the layer.

<13> A method for manufacturing the thermosensitive recording material according to any one of <1> to <12>, comprising:

forming, on a support, a thermosensitive recording layer that contains a polyvinyl alcohol and a color development component by coating;

further forming, on the thermosensitive recording layer formed on the support, a protective layer that contains a resin component by coating; and subjecting at least the thermosensitive recording layer and the protective layer to heat treatment after the forming of the protective layer, in which at least one of the thermosensitive recording layer or the protective layer further contains a styrene-isoprene resin, and a temperature range of the heat treatment is greater than or equal to the highest glass transition point of the styrene-isoprene resin but less than or equal to a color development temperature of the thermosensitive recording layer.

<14> The method for manufacturing a thermosensitive recording material according to <13>, further comprising controlling humidity of at least the thermosensitive recording layer and the protective layer before the heat treatment but after the forming of the protective layer.

<15> The method for manufacturing a thermosensitive recording material according to <14>, in which the controlling of humidity is performed under environmental conditions of a temperature of 10° C. to 40° C. and a relative humidity of greater than or equal to 50%.

According to the present disclosure, an object of the present disclosure is to provide a thermosensitive recording material which has excellent thermal color development properties and in which an occurrence of image defects such as white streaks is suppressed by suppressing deterioration of a thermal head, and a method for manufacturing the same, and the present disclosure aims to achieve the object.

In an embodiment of the present invention, image defects such as white streaks caused by deterioration of a thermal head, particularly deterioration of a thermal head caused by oxidation due to water or heat are improved. In addition, an image can be obtained in which yellowing of the image accompanied by exposure to light for a long period of time is improved and which has an image quality suitable for medical use or the like.

DESCRIPTION OF EMBODIMENTS

Hereinafter, a thermosensitive recording material of an embodiment of the present invention and a method for manufacturing the same will be described in detail.

<Thermosensitive Recording Material>

The thermosensitive recording material of the embodiment of the present invention includes: a support; a thermosensitive recording layer which is disposed on the support and contains a polyvinyl alcohol and a color development component; and a protective layer which is disposed on the thermosensitive recording layer and contains a resin component, in which at least one of the thermosensitive recording layer or the protective layer further contains a styrene-isoprene resin.

In the thermosensitive recording material of the embodiment of the present invention, the thermosensitive recording layer and the protective layer are disposed on the support in this order from the support side.

In the related art, a technique of recording an image through color development by applying heat with a thermal head has been extensively studied, and various performances such as reduction in abrasion of a thermal head and improvement in color development density have been improved. However, in medical use, for example, shades of hues in an image are information pieces directly required for diagnosis, and therefore, are expressed as an accurate image. Accordingly, in a case where a thermal head is disconnected by being physically disconnected due to printing over a long period of time and continuous printing or where a thermal head is disconnected due to promotion of abrasion caused by a chemical action, in which minute amounts of ions in a thermosensitive recording material oxidize the surface of the thermal head using moisture absorbed by the material as a medium, deterioration of color development properties occurs in a band shape. This is likely to occur, for example, in a case where a thermosensitive recording layer, a protective layer, or the like contains a water-soluble resin, such as gelatin, as a binder component having high moisture-absorbing properties. In addition, it is desirable that yellowing of an image may be suppressed for diagnosis.

In view of the above-described circumstances, in the embodiment of the present invention, at least one of the thermosensitive recording layer or the protective layer on the support contains a styrene-isoprene resin. Accordingly, at least one of the thermosensitive recording layer or the protective layer has excellent transparency and it is possible to suppress an occurrence of image defects such as white streaks caused by deterioration of a thermal head, particularly deterioration of a thermal head caused by oxidation due to water or heat. Therefore, there are no concerns that the color development efficiency may be deteriorated which is a defect in a case of using a latex of a urethane resin and yellowing of an image may be caused. In other words, the water resistance of the thermosensitive recording material of the embodiment of the present invention is improved while the thermal color development properties in the thermosensitive recording material and the yellowing resistance of an image are maintained.

Hereinafter, each layer (a protective layer, a thermosensitive recording layer, an interlayer, and the like) constituting the thermosensitive recording material of the embodiment of the present invention will be described in detail.

(Protective Layer)

The thermosensitive recording material of the embodiment of the present invention has a protective layer containing a resin component on a thermosensitive recording layer on a support.

The protective layer contains at least the resin component and may further contain other components. The protective layer reduces a thermal or physical load (a scratch, a contact trace, and the like) received from a thermal head coming into contact with the protective layer in a case of recording an image, and protects the recording surface of the thermosensitive recording material.

—Polyvinyl Alcohol—

A polyvinyl alcohol is preferable as a resin component contained in the protective layer from the viewpoint of favorable transparency. An unmodified polyvinyl alcohol (PVA), a modified polyvinyl alcohol (modified PVA), a derivative of unmodified PVA, and a derivative of modified PVA are included in the polyvinyl alcohol in one embodiment of the present invention. A polyvinyl alcohol can be used singly or in combination of two or more thereof. In addition, a polyvinyl alcohol and another water-soluble resin can be used in combination. In a case of using a polyvinyl alcohol in combination, the amount of the polyvinyl alcohol with respect to the total mass of the water-soluble resin is preferably greater than or equal to 90 mass % and more preferably greater than or equal to 95 mass %.

In the embodiment of the present invention, both an unmodified polyvinyl alcohol and a modified polyvinyl alcohol are suitable, but a modified polyvinyl alcohol is more preferable from the viewpoints of large effect of suppressing deterioration of a thermal head and more effectively suppressing the occurrence of image defects.

Examples of the modified polyvinyl alcohol include an acetoacetyl-modified polyvinyl alcohol having an acetoacetyl group, a diacetone-modified polyvinyl alcohol, a carboxy-modified polyvinyl alcohol having a carboxy group, and a silicon-modified polyvinyl alcohol.

The number average polymerization degree of a modified polyvinyl alcohol is preferably 1,000 to 3,500 and more preferably 1,500 to 3,000 from the viewpoint of enhancing barrier properties with respect to moisture.

In addition, a polyvinyl alcohol having a saponification degree of greater than or equal to 88% is preferable and a polyvinyl alcohol having a saponification degree of greater than or equal to 95% is more preferable from the viewpoint of transparency or viscosity of a preparation liquid (for example, coating liquid).

Among them, a modified polyvinyl alcohol is more preferable than an unmodified polyvinyl alcohol, and an acetoacetyl modified polyvinyl alcohol is more effectively used from the viewpoints of obtaining more excellent water resistance since those polyvinyl alcohols have more hydrophobic properties and exhibiting more excellent recording runnability in which heat resistance is improved.

A modified polyvinyl alcohol is preferably cross-linked using a cross-linking agent such as glyoxal, adipic acid dihydrazide, or an oxazoline group-containing polymer compound. Accordingly, it is possible to improve the heat resistance. Furthermore, the strength of a coated film, the recording runnability, and the barrier properties are improved, and therefore, it is possible to improve chemical resistance.

The content of the polyvinyl alcohol with respect to the total solid content of the protective layer is preferably 50 mass % to 90 mass % and more preferably 60 mass % to 80 mass %. In a case where the content of the polyvinyl alcohol is within the ranges, it is possible to improve recording runnability by improving water resistance and heat resistance without impairing transparency of a film. In addition, in a case where the content of the polyvinyl alcohol is within the above-described ranges, the barrier properties can be improved, ground fogging or fading against alcohol or a plasticizer can be suppressed, and transition of a hydrazine compound and an oxazoline group-containing compound which remain in a film can be suppressed.

—Styrene-Isoprene Resin—

In addition, the protective layer can contain a styrene-isoprene resin.

In the embodiment of the present invention, any of an aspect in which the protective layer contains a styrene-isoprene resin but a thermosensitive recording layer to be described below does not contain a styrene-isoprene resin, an aspect in which the protective layer contains a styrene-isoprene resin but the thermosensitive recording layer to be described below contains a styrene-isoprene resin, and an aspect in which both the protective layer and the thermosensitive recording layer to be described below contain a styrene-isoprene resin. In addition, a styrene-isoprene resin may be added to an interlayer or other layers as necessary in addition to at least the protective layer or the thermosensitive recording layer.

A styrene-isoprene resin preferably has a plurality of glass transition points (Tg), and a resin having two Tg's is suitable. It is possible to effectively suppress the occurrence of image defects such as white streaks appearing in an image as a unique effect which is not in the related art by maintaining thermal color development properties and suppressing the deterioration of a thermal head using, for example, the styrene-isoprene resin having two Tg's.

In a case where a styrene-isoprene resin has a first glass transition point (Tg1) and a second glass transition point (Tg2), Tg1 preferably has a low temperature region of less than or equal to 25° C. and Tg2 preferably has a high temperature region of greater than or equal to 50° C. Specifically, the temperature region of Tg1 is preferably 10° C. to 25° C. (more preferably 13° C. to 23° C.) and the temperature region of Tg2 is preferably 50° C. to 70° C. (more preferably 55° C. to 65° C.).

In addition, the relationship between Tg1 and Tg2 preferably satisfies Tg2−Tg1>20° C. In a case where the difference of Tg2−Tg1 is within a range of exceeding 20° C., cracking hardly occurs during drying and heat resistance can also be maintained, and therefore, it is effective for improving printing streaks.

Among them, Tg1 and Tg2 preferably satisfy Tg2−Tg1>30° C., and more preferably Tg2−Tg1≥35° C.

Measurement Tg obtained through actual measurement is applied for Tg.

Specifically, the measurement Tg means a value measured under usual measurement conditions using a differential scanning calorimeter (DSC) EXSTAR 6220 manufactured by SII Nanotechnology Inc. However, in a case where it is difficult to perform measurement due to decomposition of a polymer, calculation Tg calculated by the following calculation formula is applied. The calculation Tg is calculated by Formula (1).

$$1/Tg=\Sigma(Xi/Tgi) \quad (1)$$

Here, it is assumed that the polymer to be calculated is obtained such that n kinds of monomer components from i=1 to n are copolymerized. Xi is a mass fraction (ΣXi=1) of an i-th monomer and Tgi is a glass transition temperature (absolute temperature) of a homopolymer of the i-th monomer. However, Σ takes a sum from i=1 to n. A value of Polymer Handbook (3rd Edition) (written by J. Brandrup, E. H. Immergut) (Wiley-Interscience, 1989)) is adopted as a glass transition temperature (Tgi) of a homopolymer of each monomer.

The styrene-isoprene resin is a copolymer in which at least styrene and isoprene are copolymerized, and may be a bipolymer of styrene and isoprene, or may be a ter- or more polymer obtained by copolymerizing a third monomer in addition to styrene and isoprene.

The mass ratio (St:Ip) of a structural unit (St) derived from styrene to a structural unit (Ip) derived from isoprene in a styrene-isoprene copolymer is preferably 40:60 to 95:5, more preferably 45:55 to 90:10, still more preferably 55:45 to 90:10, and particularly preferably 55:45 to 80:20. In addition, the proportion of a structural unit derived from styrene to a structural unit derived from isoprene occupied in a copolymer is preferably 60 mass % to 99 mass %.

Examples of the third monomer to be copolymerized with styrene and isoprene include a monomer having ethylenically unsaturated double bond, and examples the monomer include acrylic acid, methacrylic acid, or alkyl esters of acrylic acid or methacrylic acid (for example, methyl methacrylate, ethyl methacrylate, and 2-ethyl hexyl acrylate), and unsaturated hydrocarbon (for example, butadiene).

In addition, the styrene-isoprene resin is preferably a copolymer obtained by further copolymerizing acrylic acid or methacrylic acid with styrene and isoprene, that is, a copolymer including a structural unit derived from styrene, a structural unit derived from isoprene, and a structural unit derived from acrylic acid or methacrylic acid.

The structural unit derived from acrylic acid or methacrylic acid with respect to the sum of the structural unit derived from styrene and the structural unit derived from isoprene is preferably 1 mass % to 6 mass % and more preferably 2 mass % to 5 mass %.

Specific examples of the styrene-isoprene resin include the following compounds. However, the present invention is not limited thereto.

The numerical value in parentheses represents a copolymerization ratio (unit: mass %), and Tg represents a glass transition temperature. The details of the monomers represented by abbreviations in the structures are St: styrene, Ip: isoprene, AA: acrylic acid, and Bu: butadiene.

(P-1)-St(61.5)-Ip(35.5)-AA(3)-copolymer (P-2)-St(67)-Ip(28)-Bu(2)-AA(3)-copolymer The styrene-isoprene resin can be used as a form of a latex in which particles of the styrene-isoprene resin are dispersed.

A commercially available product which has been put on the market may be used as a styrene-isoprene latex, and examples of the commercially available include LX464PX or the like manufactured by ZEON CORPORATION and PATERACOL 700D or the like manufactured by DIC CORPORATION.

The content of the styrene-isoprene resin with respect to the total solid content of the protective layer is preferably 0 mass % to 50 mass % and more preferably 0 mass % to 20 mass %. In a case where the content of the styrene-isoprene resin is within these ranges, the water resistance and the heat resistance become excellent without impairing the adhesiveness and the transparency of a layer in a case of forming the layer. Therefore, the occurrence of image defects such as white streaks is suppressed and the recording runnability also becomes favorable. In addition, the barrier properties are also improved.

—Various Additives—

Various additives (for example, an anti-sticking agent, a pigment, a release agent, a lubricant, a sliding agent, a surface gloss adjustment agent, and a matte agent) can be contained in the protective layer in addition to the above-described components.

The anti-sticking agent is added in order to prevent a thermal head from fusing with (sticking to) a thermosensitive recording material in a case of performing thermosensitive recording, prevent recording gas from adhering to a thermal head, and prevent generation of abnormal noise, and examples thereof include various pigments.

Pigments having a 50% volume-average particle diameter (hereinafter, also simply referred to as an "average particle diameter") of 0.10 μm to 5.00 μm which has been measured through a laser diffraction method are preferable as the pigments. In a case where the 50% volume-average particle diameter is within the range of 0.10 μm to 5.00 μm, an effect of decreasing abrasion on a thermal head increases and an effect of preventing welding between the thermal head and a binder in a protective layer increases. As a result, it is possible to effectively prevent so-called sticking, which is adhering of the thermal head to the protective layer of a thermosensitive recording material during printing.

Among them, the 50% volume-average particle diameter of pigments is more preferably within a range of 0.20 μm to 0.50 μm from the viewpoint of preventing the occurrence of the sticking, abnormal noise, and the like between the head and the thermosensitive recording material in a case of performing recording using the thermal head.

The 50% volume-average particle diameter of pigments is an average particle diameter of particles of the pigments corresponding to 50% volume of the total pigments which is measured using a laser diffraction particle size distribution measurement device LA700 (manufactured by HORIBA, Ltd.).

The pigments contained in the protective layer are not particularly limited, and examples thereof include well-known organic and inorganic pigments. As specific examples of the pigments, inorganic pigments such as calcium carbonate, titanium oxide, kaolin, aluminum hydroxide, amorphous silica, and zinc oxide, and organic pigments such as a urea formalin resin, an epoxy resin are suitable. Among them, kaolin, calcined kaolin, aluminum hydroxide, and amorphous silica are more preferable.

The pigments may be used singly and in a combination of two or more thereof.

In addition, the pigments may be surface-coated with at least one selected from the group consisting of a higher fatty acid, a metal salt of a higher fatty acid, and a higher alcohol. Examples of the higher fatty acid include stearic acid, palmitic acid, myristic acid, and lauric acid.

The pigments are preferably used by being dispersed such that the pigments have the above-described average particle diameters, using a known disperser (for example, a dissolver, a sand mill, and a ball mill) in the coexistence of sodium hexametaphosphate, a partially saponified or completely saponified polyvinyl alcohol, polyacrylic acid copolymer, and dispersing auxiliaries such as various surfactants (preferably a partially saponified or completely saponified polyvinyl alcohol and a polyacrylic acid copolymer ammonium salt).

That is, the pigments are preferably used after being dispersed such that the 50% volume-average particle diameter of the pigments falls within the range of 0.10 μm to 5.00 μm.

In a case where the pigments contain calcined kaolin, the content of calcined kaolin with respect to the solid content of a protective layer is preferably 0.3 mass % to 5 mass %.

In addition, the total amount of the pigments with respect to the total solid content of a coating liquid for a protective layer is preferably about 15 mass % to 35 mass %.

In addition, examples of the releasing agent, the lubricant, and the sliding agent include higher fatty acids (having 8 to 24 carbon atoms), metal salts of higher fatty acids (having 8 to 24 carbon atoms), and amide compounds represented by any one of Structural Formulas (1) to (3). As the releasing agent, the lubricant, and the sliding agent, for example, stearic acid, zinc stearate, and amide stearate are preferably used.

Structural Formula (1)

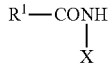

Structural Formula (2)

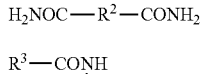

Structural Formula (3)

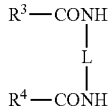

X in Structural Formulas (1) to (3) represent a hydrogen atom or $CH_2OH$. $R^1$, $R^3$, and $R^4$ each independently represent a saturated alkyl group or an unsaturated alkenyl group having 8 to 24 carbon atoms, and may have a branched structure or may be hydroxylated. $R^3$ and $R^4$ may be same as or different from each other. $R^2$ represents a saturated alkylene group or an unsaturated alkenylene group having 8 to 24 carbon atoms, and may have a branched structure or may be hydroxylated. L represents a divalent linking group represented by Structural Formula (4). In Structural Formula (4), n+m is 0 to 8.

Structural Formula (4)

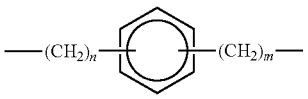

Among them, compounds represented by Structural Formula (1) or (3) are particularly preferable, and a saturated or unsaturated alkyl group having 12 to 20 carbon atoms is preferable as $R^1$, $R^3$, and $R^4$. The alkyl group may have a branch or may have a hydroxy group in the structure.

n+m is preferably 0 to 4 (particularly preferably 2) in a case of n=0 and preferably 0 to 2 in a case of n=1.

In a case where the releasing agent, the lubricant, or the sliding agent is a solid, they can be used 1) in a form of a water dispersion formed using a known disperser (for example, dissolver, a sand mill, and a ball mill) in the coexistence of a water-soluble polymer such as a polyvinyl alcohol or dispersing agents such as various surfactants, or can be used 2) in a form of an emulsion formed using a known emulsifier such as a homogenizer, a dissolver, and a colloid mill in the coexistence of a water-soluble polymer or dispersing agents such as various surfactants, after being dissolved in a solvent. In a case where the releasing agent, the lubricant, or the sliding agent is a liquid, they can be used in the form of the above-described emulsion.

A preferred average particle diameter of the emulsion is preferably 0.1 μm to 5.0 μm and more preferably 0.1 μm to 2 μm.

The average particle diameter referred to herein indicates a 50% average-particle diameter measured using a laser diffraction particle size distribution measurement device LA700 manufactured by HORIBA, Ltd. at a transmittance of 75%±1%.

In a case where the releasing agent, the lubricant, or the sliding agent is a hydrophobic organic material, it is preferable to use and emulsify those obtained by dissolving them in an organic solvent. In a case of using the releasing agent or the like as an emulsion, water-insoluble particles exist in a protective layer as liquid droplet particles containing the releasing agent or the like.

Starch particles, organic resin fine particles such as a polymethyl methacrylate resin, and inorganic pigments are used as the surface gloss adjustment agent and the matte agent. They can be used as a dispersion similarly to the pigments used for preventing sticking.

An aspect in which the content of gelatin in a protective layer with respect to the total mass of the layer is less than 10 mass % is preferable. In addition, it is preferable that the protective layer does not contain gelatin (the content of gelatin being 0 (zero) mass %). In a case where the protective layer does not substantially contain gelatin having high water absorption properties, it is possible to avoid promotion of abrasion caused by a chemical action in which minute amounts of ions in a material oxidize the surface of a thermal head using moisture as a medium.

The protective layer may contain, for example, alkyl phosphate such as alkyl phosphate potassium salt, lubricants such as amide stearate, zinc stearate, calcium stearate, and polyethylene wax, surfactants such as dialkyl sulfosuccinate, alkyl sulfonate, alkyl carboxylate, and alkyl ethylene oxide, and fluorine-based surfactants.

The protective layer may contain a cross-linking agent. Suitable examples of the cross-linking agent include glyoxal and trioxal.

The protective layer may contain a well-known hardening agent or the like. In addition, in order to homogeneously form the protective layer on a thermosensitive recording layer or an interlayer, a protective layer to be formed preferably contains a surfactant by adding the surfactant to a coating liquid for forming a protective layer.

Examples of the surfactant include sulfosuccinic acid-based alkali metal salts and fluorine-containing surfactants, and specific of the surfactant thereof include sodium salts or ammonium salts of di-(2-ethylhexyl)sulfosuccinic acid or di-(n-hexyl) sulfosuccinic acid.

Furthermore, surfactants, metal oxide fine particles, inorganic electrolyte, polymer electrolyte, and the like may be added to the protective layer for the purpose of preventing electrification of the thermosensitive recording material.

The protective layer may have a single layer structure or a laminated structure of two or more layers.

The dry coating amount of the protective layer is preferably 0.2 $g/m^2$ to 7 $g/m^2$ and more preferably 1 $g/m^2$ to 4 $g/m^2$.

The coating liquid for a protective layer is prepared, for example, by using water as a medium and mixing modified polyvinyl alcohol, and other adhesives, pigments, and additives as necessary.

It is possible to form the protective layer by performing coating and drying using the obtained coating liquid for a protective layer. The coating and drying may be performed simultaneously with coating and drying in formation of one or more other layers.

(Thermosensitive Recording Layer)

The thermosensitive recording layer contains at least a color development component, and further contains other components as necessary.

—Color Development Component—

The thermosensitive recording layer may have any composition as long as it has excellent transparency in a case of being untreated and has properties of developing color through heating. Examples of the thermosensitive recording layer include a layer (so-called two-component type thermosensitive recording layer) containing a substantially colorless color development component A (first component) and a substantially colorless color development component B (second component) that reacts with the color development component A to cause the color development component A to develop color. Among them, an aspect in which any one of the color development component A and the color development component B is encapsulated in a microcapsule is preferable.

Among them, an aspect in which the thermosensitive recording layer contains a first component that develops a color and a second component that causes the first component to develop the color, as color development components, and at least the first component is encapsulated in a microcapsule is preferable.

Examples of the combination of two components constituting the 2-component type thermosensitive recording layer include the combinations shown in following (a) to (m).

(a) A combination of an electron-donating dye precursor and an electron-accepting compound.

(b) A combination of a photodegradable diazo compound and a coupler.

(c) A combination of an organic metal salt such as silver behenate or silver stearate and a reducing agent such as protocatechuic acid, spiroindane, or hydroquinone.

(d) A combination of a long chain aliphatic salt such as ferric stearate or ferric myristate and phenols such as gallic acid or ammonium salicylate.

(e) A combination of an organic acid heavy metal salt of a nickel, cobalt, lead, copper, iron, mercury, or silver salt of acetic acid, stearic acid, palmitic acid, and the like, and an alkaline earth metal sulfide such as calcium sulfide, strontium sulfide, or potassium sulfide; or a combination of an organic acid heavy metal salt and an organic chelating agent such as s-diphenylcarbazide or diphenylcarbazone.

(f) A combination of (heavy) metal sulfate such as silver sulfide, lead sulfide, mercury sulfide, or sodium sulfide, and a sulfur compound such as Na-tetrathionate, sodium thiosulfate, or thiourea.

(g) A combination of an aliphatic ferric salt such as ferric stearate and an aromatic polyhydroxy compound such as 3,4-dihydroxytetraphenylmethane.

(h) A combination of an organic noble metal salt such as silver oxalate or mercuric oxalate and an organic polyhydroxy compound such as polyhydroxy alcohol, glycerin, or glycol.

(i) A combination of an aliphatic ferric salt such as ferric pelargonate or ferric laurate, and thiosecylcarbamide or an isothiosecylcarbamide derivative.

(j) A combination of an organic acid lead salt such as lead caproate, lead pelargonate, or lead behenate, and a thiourea derivative such as ethylene thiourea or N-dodecyl thiourea.

(k) A combination of a higher fatty acid heavy metal salt such as ferric stearate or copper stearate, and zinc dialkyldithiocarbamate.

(l) A combination, such as a combination of resorcin and nitroso compounds, which forms an oxazine dye.

(m) A combination of a formazan compound and a reducing agent and/or a metal salt.

Among them, in the thermosensitive recording material of the embodiment of the present invention, the (a) combination of an electron-donating dye precursor and an electron-accepting compound, the (b) combination of a photodegradable diazo compound and a coupler, or the (c) combination of an organic metal salt and a reducing agent is preferably used, and particularly, the (a) or (b) combination described above is more preferable.

In addition, in a case where the thermosensitive recording material of the embodiment of the present invention is formed of a thermosensitive recording layer so as to reduce a haze value calculated from (diffuse transmittance/total light transmittance)×100(%), it is possible to obtain an image having excellent transparency. This haze value is an index representing the transparency of the material, and is generally calculated from the total light transmission amount, the diffuse transmission light amount, and the parallel transmission light amount using a haze meter. In the embodiment of the present invention, examples of the method for reducing the above-described haze value include: a method for making the 50% volume-average particle diameters of both of the color development components A and B contained in the thermosensitive recording layer be less than or equal to 1.0 μm and preferably less than or equal to 0.6 μm, and allowing a binder to be contained in a range of 30 to 60 mass % of the total solid content of the thermosensitive recording layer; and a method for microcapsulating any one of the color development components A and B and using the other one, for example, as a material such as an emulsion that substantially forms a continuous layer after applying and drying the other one. In addition, a method for bringing the refractive index of a component to be used in the thermosensitive recording layer as close to a constant value as possible is also effective.

Next, the combinations (a) to (c) of the preferred composition in the thermosensitive recording layer will be described.

(a) Combination of Electron-Donating Dye Precursor and Electron-Accepting Compound The electron-donating dye precursor is not particularly limited as long as it is substantially colorless. However, the electron-donating dye precursor is preferably a colorless compound which has color developing properties by donating electrons or accepting protons such as acid, particularly has partial skeletons such as lactone, lactam, sultone, spiropyran, ester, and amide, and in which the partial skeletons are ring-opened or cleaved in a case of being brought into contact with an electron-accepting compound.

Examples of the electron-donating dye precursor include a triphenylmethane phthalide compound, fluoran compound, a phenothiazine compound, an indolyl phthalide compound, a leucoauramine compound, a rhodamine lactam compound, a triphenylmethane compound, a triazene compound, a spiropyran compound, a fluorene compound, a pyridine compound, and a pyrazine compound.

Specific examples of the triphenylmethane phthalide compounds include compounds disclosed in U.S. RE23,024, U.S. Pat. Nos. 3,491,111A, 3,491,112A, 3,491,116A, 3,509,174A, and the like. Specific examples of the fluorans include compounds disclosed in U.S. Pat. Nos. 3,624,107A, 3,627,787A, 3,641,011A, 3,462,828A, 3,681,390A, 3,920,510A, 3,959,571A, and the like. Specific examples of the spiropyran compounds include compounds disclosed in U.S. Pat. No. 3,971,808A and the like. Examples of the pyridine and pyrazine compounds include compounds disclosed in U.S. Pat. Nos. 3,775,424A, 3,853,869A, 4,246,318, and the like. Specific examples of the fluorene compounds include compounds disclosed in JP1986-240989 (JP-S61-240989) and the like. Among them, 2-arylamino-3-[H, halogen, alkyl, or alkoxy-6-substituted aminofluoran] which develops black is particularly preferably exemplified.

Specific examples thereof include 2-anilino-3-methyl-6-diethylaminofluoran, 2-anilino-3-methyl-6-N-cyclohexyl-N-methylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-anilino-3-methyl-6-N-ethyl-N-isoamylaminofluoran, 2-anilino-3-methyl-6-N-ethyl-N-dodecylaminofluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-diethylaminofluoran, 2-o-toluidino-3-methyl-6-diisopropylaminofluoran, 2-anilino-3-methyl-6-N-isobutyl-N-ethylaminofluoran, 2-anilino-3-methyl-6-N-ethyl-N-tetrahydrofurfuryl aminofluoran, 2-anilino-3-chloro-6-N-ethyl-N-isoamylaminofluoran, 2-anilino-3-methyl-6-N-methyl-N-γ-ethoxypropylaminofluoran, 2-anilino-3-methyl-6-N-ethyl-N-γ-ethoxypropylaminofluoran, and 2-anilino-3-methyl-6-N-ethyl-N-γ-ethoxypropylaminofluoran.

Examples of the electron-accepting compound acting with the electron-donating dye precursor include acidic substances such as phenol compounds, organic acids or metal salts thereof, and oxybenzoate, and examples thereof include compounds disclosed in JP1986-291183A (JP-S61-291183A).

Specific examples of the electron-accepting compounds include bisphenol compounds [for example, 2,2-bis(4'-hydroxyphenyl)propane (general name: bisphenol A), 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 2,2-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methyl-pentane, 1,1-bis(4'-hydroxyphenyl)-2-ethyl-hexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulfone, bis(3-allyl-4-hydroxyphenyl)sulfone, and bis(p-hydroxyphenyl)acetic acid benzyl ester], salicylic acid derivatives [for example, 3,5-di-α-methylbenzyl salicylic acid, 3,5-di-tertiary butyl salicylic acid, 3-α-α-dimethylbenzyl salicylic acid, 4-(β-p-methoxyphenoxyethoxy) salicylic acid] and polyvalent metal salts thereof (particularly, zinc and aluminum are preferable), oxybenzoic acid esters [for example, p-hydroxy benzoic acid benzyl ester, p-hydroxy benzoic acid-2-ethylhexyl ester, β-resorcylic acid-(2-phenoxyethyl)ester], and phenols [for example, phenylphenol, 3,5-diphenylphenol, cumylphenol, 4-hydroxy-4'-isopropoxy-diphenylsulfone, and 4-hydroxy-4'-phenoxy-diphenylsulfone].

Among them, bisphenol compound is particularly preferable from the viewpoint of obtaining favorable color development characteristics.

In addition, the electron-accepting compound may be used singly or in a combination of two or more thereof.

(b) Combination of Photodegradable Diazo Compound and Coupler

The photodegradable diazo compound is subjected to a coupling reaction with a coupler which is a coupling component to be described below, to develop color into a desirable hue. The photodegradable diazo compound is a photodegradable diazo compound which degrades in a case of receiving light in a specific wavelength region before the reaction and loses a color development ability even in a case where there has already been a coupling component. The hue in this color development system is determined by diazo coloring agent generated through a reaction between a diazo compound and a coupler. Accordingly, it is possible to easily change the color development hue by changing the chemical structure of the diazo compound or the coupler and to obtain an arbitrary color development hue depending on the combination.

An Example of the photodegradable diazo compound includes an aromatic diazo compound, and specific examples thereof include an aromatic diazonium salt, a diazosulfonate compound, and a diazoamino compound.

An example of the aromatic diazonium salt includes the compound represented by the following general Formula, but the present invention is not limited thereto. In addition, an aromatic diazonium salt which has excellent photofixability, and in which a colored stain after fixing is hardly generated and a color development portion is stable is preferably used as the aromatic diazonium salt.

$$Ar—N_2^+ + X^-$$

In the formula, Ar represents a substituted or unsubstituted aromatic hydrocarbon ring group, $N_2^+$ represents a diazonium group, and $X^-$ represents an acid anion.

As the diazosulfonate compound, a large number of diazosulfonate compounds have been known in recent years, and the diazosulfonate compound can be obtained by treating each diazonium salt with a sulfite, and therefore, it is possible to suitably use the diazosulfonate compound in the thermosensitive recording material of the embodiment of the present invention.

The diazoamino compound can be obtained by coupling a diazo group with dicyandiamide, sarcosine, methyltaurine, N-ethyl anthranic acid-5-sulfonic acid, monoethanolamine, diethanolamine, guanidine, or the like, and can be suitably used in the thermosensitive recording material of the embodiment of the present invention. The details of these diazo compounds are disclosed in detail, for example, in JP1990-136286A (JP-H2-136286A).

On the other hand, examples of the coupler used for a coupling reaction of the above-described diazo compounds include compounds, including resorcin, disclosed in JP1987-146678A (JP-S62-146678A) in addition to 2-hydroxy-3-naphthoic acid anilide.

In a case where a combination of a diazo compound and a coupler is used in a thermosensitive recording layer, a basic substance may be added thereto as a sensitizer from the viewpoint that a coupling reaction can be further promoted by being performed in a basic atmosphere. Examples of the basic substance include a water-insoluble or slightly water-soluble basic substance and a substance that generates alkali through heating. Examples thereof include nitrogen-containing compounds such as inorganic or organic ammonium salts, derivatives of inorganic or organic ammonium salts, organic amines, derivatives of organic amines, amides, derivatives of amides, urea, derivatives of urea, thiourea, derivatives of thiourea, thiazoles, pyrroles, pyrimidines, piperazines, guanidines, indoles, imidazoles, imidazolines, triazoles, morpholines, piperidines, amidines, formazines, and pyridines. Specific examples thereof include compounds disclosed in JP1986-291183A (JP-S61-291183A).

(c) Combination of Organic Metal Salt and Reducing Agent

Examples of the organic metal salt include silver salts of long-chain aliphatic carboxylic acids such as silver laurate, silver myristate, silver palmitate, silver stearate, silver arachidate, and silver behenate; silver salts of organic compounds having an imino group such as benzotriazole silver salts, a benzimidazole silver salts, carbazole silver salts, and phthalazinone silver salts; silver salts of sulfur-containing compounds such as s-alkylthioglycolate; silver salts of aromatic carboxylic acids such as silver benzoate and silver phthalate; silver salts of sulfonic acid such as silver ethanesulfonate; silver salts of sulfonic acid such as silver o-toluenesulfinate; silver salts of phosphoric acid such as silver phenyl phosphate; silver salts of silver barbiturate, silver saccharinate, and salicylaldoxime; and arbitrary mixtures thereof.

Among them, long-chain aliphatic carboxylic acids are preferable. Among them, silver behenate is more preferable. In addition, behenic acid may be added to silver behenate.

The reducing agent can be appropriately used based on the disclosure in page 227, lower left column, line 14 to page 229, upper right column, line 11 in JP1978-1020A (JP-S53-1020A). Among them, mono-, bis-, tris-, or tetrakisphenols, mono- or bisnaphthols, di- or polyhydroxy naphthalenes, di- or polyhydroxy benzenes, hydroxy monoethers, ascorbic acids, 3-pyrazolidones, pyrazolines, pyrazolones, reducing saccharides, phenylene diamines, hydroxylamines, reductones, hydroxamic acids, hydrazides, amidoximes, and N-hydroxyureas are preferably used as the reducing agent. Among the above reducing agents, aromatic organic reducing agents such as polyphenols, sulfoneamidephenols, and naphthols are particularly preferable.

In order to ensure the transparency of the thermosensitive recording material, it is preferable to use the (a) combination of an electron-donating dye precursor and an electron-accepting compound or the (b) combination of a photodegradable diazo compound and a coupler as the color development component of the thermosensitive recording layer.

In addition, in the embodiment of the present invention, it is preferable that any one of the color development component A (first component) and the color development component B (second component) is used by being encapsulated in a microcapsule, and it is more preferable that an electron-donating dye precursor or a photodegradable diazo compound is used by being encapsulated in a microcapsule. It is still more preferable that the first component (specifically, an electron-donating dye precursor) is used by being encapsulated in a microcapsule.

~Microcapsule~

Hereinafter, A method for manufacturing a microcapsule will be described in detail.

There is an interfacial polymerization method, an internal polymerization method, an external polymerization method, and the like for manufacturing a microcapsule, and any of the methods can be employed. As described above, in the thermosensitive recording material of the embodiment of the present invention, it is preferable that an electron-donating dye precursor or a photodegradable diazo compound is encapsulated in a microcapsule. Particularly, an interfacial polymerization method is preferably employed in which an oil phase prepared by dissolving or dispersing an electron-donating dye precursor or a photodegradable diazo compound which becomes a core of a capsule in a hydrophobic organic solvent is mixed in a water phase in which a water-soluble polymer is dissolved, the mixture is emulsified and dispersed by means such as homogenizer, and then, a polymer formation reaction is caused in an oil droplet interface thereof through heating to form a microcapsule wall of a polymeric substance.

The reactant forming the polymeric substance is added to the inside and/or the outside of the oil droplets.

Specific examples of the polymeric substance include polyurethane, polyurea, polyamide, polyester, polycarbonate, a urea-formaldehyde resin, a melamine resin, polystyrene, a styrene methacrylate copolymer, and a styrene-acrylate copolymer. Among them, polyurethane, polyurea, polyamide, polyester, and polycarbonate are preferable and polyurethane and polyurea are particularly preferable.

For example, in a case where polyurea is used as a capsule wall material, it is possible to easily form a microcapsule wall by reacting polyurea with polyisocyanate such as diisocyanate, triisocyanate, tetraisocyanate, and a polyisocyanate prepolymer, polyamine such as diamine, triamine, and tetraamine, a prepolymer having two or more amino groups, piperazine or a derivative thereof, a polyol, and the like through an interfacial polymerization method in the above-described water phase.

In addition, a composite wall consisting, for example, of polyurea and polyamide or a composite wall consisting of polyurethane and polyamide can be prepared by mixing, for example, polyisocyanate and a second substance (for example, acid chloride, polyamine, or polyol) which forms a capsule wall by reacting with polyisocyanate into a water-soluble polymer aqueous solution (water phase) or into an oily medium (oil phase) to be encapsulated, emulsifying and dispersing the mixture, and then, heating. The details of the method for manufacturing this composite wall consisting of polyurea and polyamide are disclosed in JP1983-66948A (JP-S58-66948A).

A compound having a tri- or more functional isocyanate group is preferable as the polyisocyanate compound. However, a bifunctional isocyanate group may be used in combination. Specific examples thereof include: compounds which are obtained by introducing a polymer compound such as polyether having an active hydrogen such as polyethylene oxide into a polyfunctional compound used as an adduct of a polyol such as trimethylolpropane and bifunctional isocyanate such as xylylene diisocyanate and an adduct of a polyol such as trimethylolpropane and bifunctional isocyanate such as xylylene diisocyanate in addition to a dimer or a trimer (biuret or isocyanurate) of main raw materials as which diisocyanates such as xylene diisocyanate and a hydrogenated product, hexamethylene diisocyanate, tolylene diisocyanate, and a hydrogenated product thereof, and isophorone diisocyanate are used; and a formalin condensate of benzene isocyanate. Compounds disclosed in JP1987-212190A (JP-S62-212190A), JP1992-26189A (JP-H4-26189A), JP1993-317694A (JP-H5-317694A), JP1996-268721 (JP-H8-268721), and the like are preferable.

Polyisocyanate is preferably added such that the average particle diameter of a microcapsule falls within a range of 0.3 μm to 12 μm and the thickness of a capsule wall falls within a range of 0.01 μm to 0.3 μm.

In general, the dispersed particle diameter is about 0.2 μm to 10 μm.

Specific examples of a polyol and polyamine to be added to at least one of a water phase or an oil phase as a constituent of a microcapsule wall by reacting with polyisocyanate include propylene glycol, glycerin, trimethylolpropane, triethanolamine, sorbitol, and hexamethylenediamine. In a case where a polyol is added, a polyurethane wall is formed. In the above-described reaction, it is preferable to keep the reaction temperature high or to add an appropriate polymerization catalyst from the viewpoint of accelerating the reaction rate. Polyisocyanate, a polyol, a reaction catalyst, polyamine, which is used for forming a part of a wall material, and the like are detailed in the book (written by KEUI IWATA, Polyurethane Handbook, NIKKAN KOGYO SHIMBUN, LTD. (1987)).

In addition, a metal-containing dye, a charge adjuster such as nigrosine, or other arbitrary additive substances can be added to the microcapsule wall as necessary. These additives can be contained in a capsule wall at the time of forming a wall or at an arbitrary point in time. In addition, a monomer such as a vinyl monomer may be graft-polymerized in order to control the chargeability of the surface of a capsule wall as necessary.

Furthermore, a plasticizer suitable for a polymer used as a wall material is preferably used in order to make the microcapsule wall have excellent substance permeability even under a low temperature condition and have high color developing properties. A plasticizer having a melting point of higher than or equal to 50° C. is preferable and a plasticizer having a melting point of lower than or equal to 120° C. is more preferable. Among them, it is possible to suitably select any solid plasticizer at room temperature. For example, in a case where a wall material is made of polyurea and polyurethane, a hydroxy compound, a carbamic acid ester compound, an aromatic alkoxy compound, an organic sulfonamide compound, an aliphatic amide compound, an arylamide compound, and the like are suitably used.

In a case of preparing an oil phase, an organic solvent having a boiling point of 100° C. to 300° C. is preferable as a hydrophobic organic solvent used in a case of dissolving an electron-donating dye precursor or a photodegradable diazo compound and forming a core of a microcapsule. Specific examples thereof include dimethylnaphthalene, diethylnaphthalene, diisopropylnaphthalene, dimethylbiphenyl, diisopropylbiphenyl, diisobutylbiphenyl, 1-methyl-1-dimethylphenyl-2-phenylmethane, 1-ethyl-1-dimethylphenyl-1-phenylmethane, 1-propyl-1-dimethylphenyl-1-phenylmethane, triarylmethane (for example, tritoluylmethane and toluyldiphenylmethane), terphenyl compound (for example, terphenyl), alkyl compound, alkylated diphenyl ether (for example, propyl diphenyl ether), hydrogenated terphenyl (for example, hexahydro terphenyl), and diphenyl ether, in addition to ester compounds.

Among them, it is particularly preferable to use ester compounds from the viewpoint of emulsification stability of an emulsified dispersion.

Examples of the ester compounds include phosphoric acid esters such as triphenyl phosphate, tricresyl phosphate, butyl phosphate, octyl phosphate, and cresyl phenyl phosphate; phthalic acid esters such as dibutyl phthalate, 2-ethylhexyl phthalate, ethyl phthalate, octyl phthalate, and butyl benzyl phthalate; dioctyl tetrahydrophthalate; benzoic acid esters such as ethyl benzoate, propyl benzoate, butyl benzoate, isopentyl benzoate, and benzyl benzoate; abietic acid esters such as ethyl abietate and benzyl abietate; dioctyl adipate; isodecyl succinate; dioctyl azelate; oxalic acid esters such as dibutyl oxalate and dipentyl oxalate; diethyl malonate; maleic acid esters such as dimethyl maleate, diethyl maleate, and dibutyl maleate; tributyl citrate; sorbic acid esters such as methyl sorbate, ethyl sorbate, and butyl sorbate; cebacic acid esters such as dibutyl sebacate and dioctyl sebacate; ethylene glycol esters such as formic acid monoesters and diesters, butyric acid monoesters and diesters, lauric acid monoesters and diesters, palmitic acid monoesters and diesters, stearic acid monoesters and diesters, and oleic acid monoesters and diesters; triacetin; diethyl carbonate; diphenyl carbonate; ethylene carbonate; propylene carbonate; and borate esters such as tributyl borate and tripentyl borate.

Among them, a case where tricresyl phosphate is used singly or in combination is particularly preferable since the stability of an emulsion becomes most favorable. A combination of the above-described each oil or a combination of the above-described each oil and other oil can also be used.

In a case where solubility of an electron-donating dye precursor or a photodegradable diazo compound to be encapsulated with respect to a hydrophobic organic solvent is inferior, a low boiling point solvent having high solubility can also be used subsidiarily in combination. Preferred examples of such a low boiling point solvent include ethyl acetate, isopropyl acetate, butyl acetate, and methylene chloride.

In a case where an electron-donating dye precursor or a photodegradable diazo compound is used in a thermosensitive recording layer of a thermosensitive recording material, the content of the electron-donating dye precursor is preferably 0.1 $g/m^2$ to 5.0 $g/m^2$ and more preferably 1.0 $g/m^2$ to 4.0 $g/m^2$.

In addition, the content of the photodegradable diazo compound is preferably 0.02 $g/m^2$ to 5.0 $g/m^2$, and more preferably 0.10 $g/m^2$ to 4.0 $g/m^2$ from the viewpoint of color development density.

In a case where the content of the electron-donating dye precursor is within the range of 0.1 $g/m^2$ to 5.0 $g/m^2$, sufficient color development density can be obtained. In addition, in a case where the content of both of the electron-donating dye precursor and the photodegradable diazo compound is within 5.0 $g/m^2$, it is possible to maintain the sufficient color development density and maintain transparency of the thermosensitive recording layer.

On the other hand, an aqueous solution in which a water-soluble polymer is dissolved as a protective colloid is used as a water phase to be used, and emulsification and dispersion is performed by means such as homogenizer after adding an oil phase to the aqueous solution. The water-soluble polymer acts as a dispersion medium which makes dispersion be homogeneous and easy and stabilizes the aqueous solution which has been emulsified and dispersed. Here, a surfactant may be added to at least the oil phase or the water phase in order to stabilize the aqueous solution by further homogeneously emulsifying and dispersing the aqueous solution. A well-known emulsifying surfactant can be used as the surfactant.

The amount of the surfactant added is, with respect to the mass of the oil phase, preferably 0.1 mass % to 5 mass % and more preferably 0.5 mass % to 2 mass %.

Compounds which do not cause precipitation and aggregation by acting with a protective colloid can be suitably selected from anionic or nonionic surfactant as the surfactant to be contained in the water phase. Preferred examples of the surfactant include sodium alkylbenzene sulfonate, sodium alkyl sulfate, dioctyl sodium sulfosuccinate, and polyalkylene glycol (for example, polyoxyethylene nonylphenyl ether).

The emulsification can be easily performed using means, for example, well-known emulsifying devices such as a homogenizer, Manton Goalie, an ultrasonic dispersing machine, a dissolver, and a Kedi mill, in which an oil phase containing the above-described components and a water phase containing a protective colloid and a surfactant are used for ordinary fine particle emulsification such as high speed agitation and ultrasonic dispersion. After the emulsification, it is preferable to heat the emulsion to 30 to 70° C. in order to promote a capsule wall formation reaction. In addition, it is preferable to reduce collision probability of capsules by adding water to the emulsion or to perform sufficient agitation in order to prevent aggregation between the capsules during the reaction.

In addition, a dispersion for preventing aggregation may be added thereto again during the reaction. Generation of carbon dioxide gas is observed in accordance with the progress of a polymerization reaction, and the end of the generation of carbon dioxide gas can be regarded as an end point of the general capsule wall formation reaction. In general, it is possible to obtain a target microcapsule by performing the reaction for several hours.

~Solid Dispersion~

In a case where an electron-donating dye precursor or a photodegradable diazo compound is encapsulated as a core material, an electron-accepting compound or a coupler is used by being solid-dispersed by means such as a sand mill together with a water-soluble polymer, an organic base, and other color development auxiliaries, for example. In this case, the preferred diameter of dispersion particles is less than or equal to 1 μm.

The water-soluble polymer to be contained as a protective colloid can be appropriately selected from well-known anionic polymers, nonionic polymers, and amphoteric polymers. A water-soluble polymer having a solubility in water of greater than or equal to 5% at a temperature to be emulsified is preferable. Specific examples of the water-soluble polymer include a polyvinyl alcohol or a modified product thereof, polyacrylic acid amide or a derivative thereof, an ethylene-vinyl acetate copolymer, a styrene-maleic anhydride copolymer, an ethylene-maleic anhydride copolymer, isobutylene-maleic anhydride copolymer, polyvinyl pyrrolidone, ethylene-acrylic acid copolymer, vinyl acetate-acrylic acid copolymer, cellulose derivatives such as carboxymethyl cellulose and methyl cellulose, casein, gelatin, starch derivatives, gum Arabic, and sodium alginate. Among them, a polyvinyl alcohol, gelatin, and cellulose derivatives are particularly preferable.

In addition, the mixing ratio (solid content mass/water phase mass) is preferably 0.1 to 0.5 and more preferably 0.2 to 0.4. In a case where the mixing ratio is within the range of 0.1 to 0.5, the viscosity can be kept at an appropriate level, and the moisture has excellent manufacturing suitability and coating liquid stability.

In a case where an electron-accepting compound is used in the thermosensitive recording material, the electron-accepting compound is, with respect to 1 part by mass of an electron-donating dye precursor, preferably 0.5 parts by mass to 30 parts by mass and more preferably 1.0 parts by mass to 10 parts by mass.

In addition, in a case where a coupler is used in the thermosensitive recording material of the embodiment of the present invention, the coupler with respect to 1 part by mass of a diazo compound is preferably 0.1 parts by mass to 30 parts by mass.

—Resin Component—

The thermosensitive recording layer can contain a polyvinyl alcohol, a styrene-isoprene resin, and other resins as resin components.

An unmodified polyvinyl alcohol (PVA), a modified polyvinyl alcohol (modified PVA), a derivative of unmodified PVA, and a derivative of modified PVA are included in the polyvinyl alcohol. A polyvinyl alcohol can be used singly or in combination of two or more thereof. In addition, a polyvinyl alcohol and another water-soluble resin can be used in combination. In a case where a polyvinyl alcohol and another water-soluble resin are used in combination, the amount of the polyvinyl alcohol with respect to the total mass of the water-soluble resin is preferably greater than or equal to 90 mass % and more preferably greater than or equal to 95 mass %.

In the embodiment of the present invention, both an unmodified polyvinyl alcohol and a modified polyvinyl alcohol are suitable, but a modified polyvinyl alcohol is more preferable from the viewpoints of large effect of suppressing deterioration of a thermal head and more effectively suppressing occurrence of image defects.

A polyvinyl alcohol the same as the polyvinyl alcohol that can be used in the protective layer can be used as the polyvinyl alcohol. The details of the polyvinyl alcohol are as described in the section of the protective layer, and a preferred aspect is also the same as that in the section.

The content of the polyvinyl alcohol of the thermosensitive recording layer with respect to the layer solid content is preferably 10 mass % to 80 mass % and more preferably 20 mass % to 50 mass %.

In addition, the above-described protective layer may or may not contain a styrene-isoprene resin, and the thermosensitive recording layer may contain a styrene-isoprene resin. In the embodiment of the present invention, an aspect is preferable in which both of the protective layer and the thermosensitive recording layer contain a styrene-isoprene resin.

The styrene-isoprene resin is a copolymer obtained by copolymerizing at least styrene and isoprene. The styrene-isoprene resin may be a bipolymer of styrene and isoprene, or may be a ter- or more polymer obtained by copolymerizing a third monomer in addition to styrene and isoprene.

In addition, the styrene-isoprene resin is a resin having two glass transition points (Tg). The occurrence of image defects such as white streaks appearing in an image is effectively suppressed as a unique effect which is not in the related art by suppressing the deterioration of a thermal head using the styrene-isoprene resin having two Tg's.

A styrene-isoprene resin the same as the styrene-isoprene resin that can be used in the protective layer can be used as the styrene-isoprene resin. The details of the styrene-isoprene resin are as described in the section of the protective layer, and a preferred aspect is also the same as that in the section.

The content of the styrene-isoprene resin with respect to the total solid content of the thermosensitive recording layer is preferably 5 mass % to 50 mass % and more preferably 10 mass % to 40 mass %. In a case where the content of the styrene-isoprene resin is within the ranges, water resistance and heat resistance become excellent without impairing transparency of a layer in a case where the layer is formed, and adhesiveness. Therefore, the occurrence of image defects such as white streaks is suppressed and recording runnability becomes also favorable. In addition, barrier properties also improve.

—Other Components—

Other components that can be contained in the thermosensitive recording layer are not particularly limited, and can be appropriately selected in accordance with the purpose. Examples thereof include well-known heat-fusible substances, ultraviolet absorbents, and antioxidants.

An aspect in which the content of gelatin in the thermosensitive recording layer with respect to the total mass of the layer is less than 10 mass % is preferable. In addition, it is preferable that the thermosensitive recording layer does not contain gelatin (the content of gelatin being 0 (zero) mass %). In a case where the thermosensitive recording layer does not substantially contain gelatin having high water absorption properties, it is possible to avoid promotion of abrasion caused by a chemical action in which minute amounts of ions in a material oxidize the surface of a thermal head using moisture as a medium.

The heat-fusible substances can be contained in the thermosensitive recording layer for the purpose of improving thermal response.

Examples of the heat-fusible substances include aromatic ethers, thioethers, esters, aliphatic amides, and ureides. These examples are disclosed in JP1983-57989A (JP-S58-57989A), JP1983-87094A (JP-S58-87094A), JP1986-58789A (JP-S61-58789A), JP1987-109681A (JP-S62-109681A), JP1987-132674A (JP-S62-132674A), JP1988-151478A (JP-S63-151478A), JP1988-235961A (JP-S63-235961A), JP1990-184489A (JP-H2-184489A), and JP1990-215585A (JP-H2-215585A).

Suitable examples of the ultraviolet absorbent include a benzophenone type ultraviolet absorbent, a benzotriazole type ultraviolet absorbent, a salicylic acid type ultraviolet absorbent, a cyanoacrylate type ultraviolet absorbent, and an oxalic acid anilide type ultraviolet absorbent. These examples are disclosed in JP1972-10537A (JP-S47-10537A), JP1983-111942A (JP-S58-111942A), JP1983-212844A (JP-S58-212844A), JP1984-19945A (JP-S59-19945A), JP1984-46646A (JP-S59-46646A), JP1984-109055A (JP-S59-109055A), JP1988-53544A (JP-S63-53544A), JP1961-10466B (JP-S36-10466B), JP1967-26187B (JP-S42-26187B), JP1973-30492B (JP-S48-30492B), JP1973-31255B (JP-S48-31255B), JP1973-41572B (JP-S48-41572B), JP1973-54965B (JP-S48-54965B), JP1975-10726B (JP-S50-10726B), U.S. Pat. Nos. 2,719,086A, 3,707,375A, 3,754,919A, 4,220,711A.

Suitable examples of the antioxidant include a hindered amine based antioxidant, a hindered phenol based antioxidant, an aniline based antioxidant, and a quinoline based antioxidant. The examples are disclosed in JP1984-155090A (JP-S59-155090A), JP1985-107383A (JP-S60-107383A), JP1985-107384A (JP-S60-107384A), JP1986-137770A (JP-S61-137770A), JP1986-139481A (JP-S61-139481A), and JP1986-160287A (JP-S61-160287A).

The thermosensitive recording layer may contain a cross-linking agent. Suitable examples of the cross-linking agent include glyoxal and trioxal.

The coating amount of the other components is preferably 0.05 g/m$^2$ to 1.0 g/m$^2$ and more preferably 0.1 g/m$^2$ to 0.4 g/m$^2$.

The other components may be added to the inside of a microcapsule, or may be added to the outside of a microcapsule.

The thermosensitive recording layer is preferably formed through coating such that the dry coating amount after drying becomes 1 g/m$^2$ to 25 g/m$^2$. In addition, the thermosensitive recording layer is preferably formed through coating such that the layer thickness becomes 1 μm to 25 μm.

The thermosensitive recording layer may have a structure in which two or more layers are laminated. In this case, the dry coating amount after all of the thermosensitive recording layers are coated and dried is preferably within the range of 1 g/m$^2$ to 25 g/m$^2$.

~Coating Liquid for Thermosensitive Recording Layer~

The coating liquid for a thermosensitive recording layer can be prepared, for example, using the microcapsule liquid and the solid dispersion liquid prepared as described above. Here, the water-soluble polymer used as a protective colloid in a case of preparing the microcapsule liquid and a water-soluble polymer used as a protective colloid in a case of preparing the emulsified dispersion function as binders in the thermosensitive recording layer. In addition, a coating liquid for a thermosensitive recording layer may be prepared by adding a binder separately from these protective colloids and mixing the mixture. A water-soluble binder is generally used as the binder to be added, and examples thereof include polyvinyl alcohol, hydroxyethyl cellulose, hydroxypropyl cellulose, epichlorohydrin-modified polyamide, ethylene-maleic copolymer, styrene-maleic anhydride copolymer, isobutylene-maleic anhydride salicylic acid copolymer, polyacrylic acid, polyacrylic acid amide, methylol-modified polyacrylamide, and casein. In addition, it is also possible to add a water-resistant agent to binders for the purpose of imparting water resistance to the binders, or to add silica particles, zirconia particles, or the like to the binders in order to change elastic stress.

In a case of coating a support with a coating liquid for a thermosensitive recording layer, well-known coating means used in a water-based or organic solvent-based coating liquid is used. In this case, methyl cellulose, carboxymethyl cellulose, hydroxyethyl cellulose, polyvinyl alcohol, carboxy-modified polyvinyl alcohol, polyacrylamide, polystyrene or a copolymer thereof, polyester or a copolymer thereof, polyethylene or a copolymer thereof, an epoxy resin, an acrylate resin or a copolymer thereof, a methacrylate resin or a copolymer thereof, a polyurethane resin, a polyamide resin, and a polyvinyl butyral resin can be used in the thermosensitive recording material of the embodiment of the present invention in order to safely perform homogeneous coating using the coating liquid for a thermosensitive recording layer and to maintain the strength of the coated film.

(InterLayer)

In the thermosensitive recording material of the embodiment of the present invention, it is possible to provide an interlayer between at least a set of adjacent two layers among a plurality of layers including at least a thermosensitive recording layer and a protective layer. The plurality of layers include a gas shielding layer, an ultraviolet filter layer, a light reflection prevention layer, an undercoat layer, and the like in addition to the thermosensitive recording layer and the protective layer.

The interlayer is preferably a layer containing at least a polyvinyl alcohol, and preferably contains modified PVA from the viewpoints of suppressing deterioration of a thermal head and preventing occurrence of image defects. The details of the polyvinyl alcohol are the same as those of the polyvinyl alcohol in the protective layer.

A polymer latex may be added to the interlayer in order to enhance adhesion between the interlayer and an adjacent layer adjacent to the interlayer. The interlayer is preferably formed using a latex, in which particles of a styrene-isoprene resin are dispersed, as the polymer latex.

The amount of the particles of the styrene-isoprene resin with respect to the amount of a polyvinyl alcohol is preferably within a range of 0 mass % to 20 mass %.

In addition, the interlayer may contain various surfactant in order to impart coating suitability. In addition, in order to more enhance gas barrier properties, the interlayer preferably contains inorganic fine particles of mica or the like within a range of 2 mass % to 20 mass % with respect to the binder, and the more preferred range of the content is 5 mass % to 10 mass %.

The density of the polyvinyl alcohol in the interlayer with respect to the total solid content of the layer is preferably 3 mass % to 25 mass %, and more preferably 5 mass % to 15 mass %.

In addition, any one of the interlayer and an adjacent layer thereof may contain a phenol compound.

The phenol compound causes an interaction with a polyvinyl alcohol and a polymer latex contained in the interlayer, and an interface between layers gelates, thereby improving the effect of preventing mixing of layers with each other.

Furthermore, in a case where the interlayer is dried at a temperature of about 50° C. or higher, a temperature of 50° C. or higher, an interaction between the phenol compound and the polyvinyl alcohol is added, and therefore, the effect of preventing the mixing between layers becomes significantly large. In addition, the surface state does not deteriorate due to at least one of the interaction or setting properties of the polyvinyl alcohol even in a case where drying is performed using high speed air, and a thermosensitive recording material having an excellent surface state is obtained. Particularly, in a case where two layers in contact with the interlayer mainly contain a polyvinyl alcohol or a polymer latex as a binder, coatability in a case of forming the two layers in contact with the interlayer through coating significantly improves.

In a case where an interlayer, an adjacent layer thereof, and the like are formed through coating and drying, a phenol compound is preferably contained in the layer adjacent to the interlayer. However, in a case where simultaneous multilayer coating is performed, the effect of improving the setting properties is obtained even in a case where the phenol compound is contained in any layer.

Any compound having one or more phenolic hydroxyl groups in a molecule can be used as the phenol compound. For example, a phenol compound (for example, phenols disclosed in paragraphs 0032 and 0033 of JP2000-272243A) used as an electron-accepting compound which is a second component developing the color of an electron-donating colorless dye which is a color development component (first component) of a thermosensitive recording material can be used in addition to a bisphenol compound, a bisphenol sulfone compound, and a bisphenol sulfine compound shown below.

In the following compounds, "t-Bu" represents a tertiary butyl group and "i-pr" represents an isopropyl group.

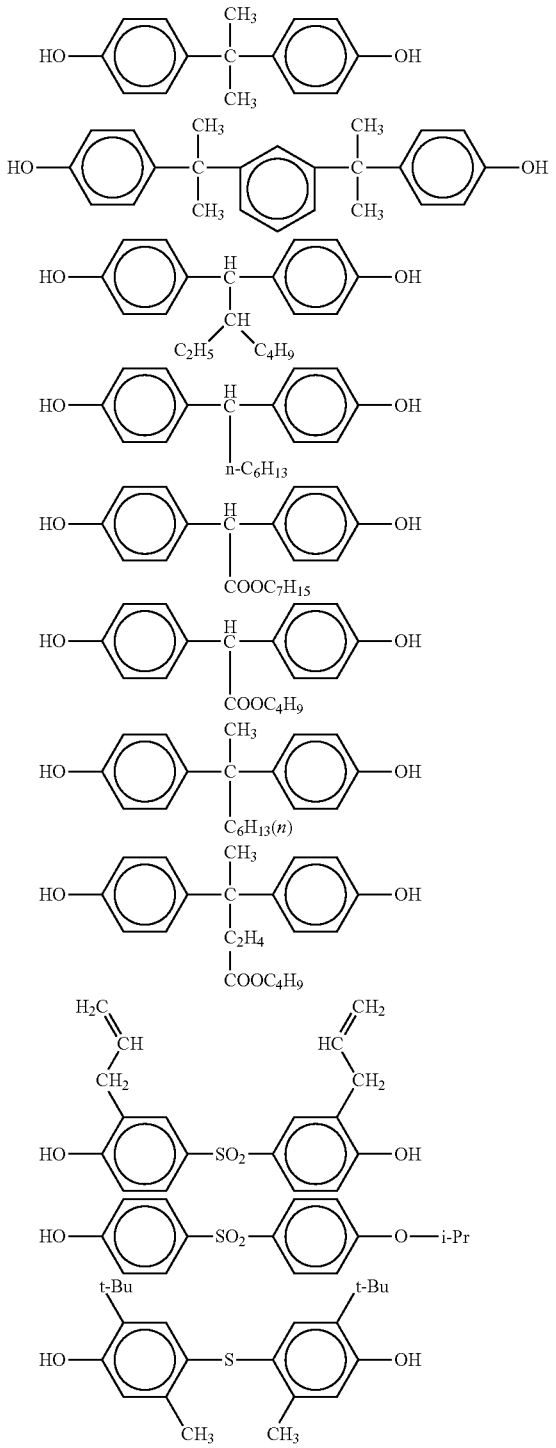

In addition, in a case where an electron-donating colorless dye is used as a color development component of a thermosensitive recording layer and phenols are used as electron-accepting compounds for developing the color of the electron-donating colorless dye, phenols may also be used as phenol compounds for improving the setting properties of an interlayer containing a polyvinyl alcohol.

It is disclosed in JP2003-94826A that it is preferable to add an emulsion liquid of phenol compounds to a coating liquid of each layer in order to make the phenol compounds in each layer. However, an interaction between a polymer latex and a polyvinyl alcohol becomes too strong. Therefore, the phenol compounds are preferably added to the coating liquid as a solid dispersion. In a case of preparing the dispersion, it is preferable to use a polyvinyl alcohol as a stabilizer from the viewpoints of stability of the dispersion, handling of the coating liquid, and diffusibility during multilayer coating. Furthermore, in a case of preparing the dispersion, it is preferable to solid-disperse the phenol compounds with water using a beads mill.

The amount of the phenol compounds added changes depending on the molecular weight distribution or the like of a protective colloid, PVA, or a polymer latex to be used, but is, with respect to the solid content of PVA of an adjacent layer, preferably greater than or equal to 5 mass % and particularly preferably greater than or equal to 10 mass %.

The interlayer may contain a cross-linking agent. Suitable examples of the cross-linking agent include glyoxal and trioxal.

(Other Layer)

In the thermosensitive recording material of the embodiment of the present invention, it is possible to provide other layers such as an undercoat layer, an ultraviolet filter layer, a light reflection prevention layer, and the like on a support as the other layers.

—Undercoat Layer—

In the thermosensitive recording material of the embodiment of the present invention, it is desirable to provide an undercoat layer on a support before coating a thermosensitive recording layer, which contains a microcapsule or the like, and a light reflection prevention layer to be described below for the purpose of preventing peeling of the thermosensitive recording layer from the support. An acrylic acid ester copolymer, polyvinylidene chloride, styrene-butadiene rubber (SBR), and aqueous polyester can be used as the undercoat layer. In a case of forming a thermosensitive recording layer on an undercoat layer, the undercoat layer swells due to water contained in a coating liquid for a thermosensitive recording layer, and an image recorded on the thermosensitive recording layer deteriorates. Therefore, it is desirable to harden the thermosensitive recording layer using dialdehydes such as glutaraldehyde and 2,3-dihydroxy-1,4-dioxane and a hardening agent such as boric acid.

With respect to the amount of the hardening agent to be added, an appropriate addition amount of the hardening agent may be selected within a range of 0.20 mass % to 3.0 mass % with respect to the total mass of the undercoat layer in accordance with the desired degree of hardening. The film thickness of the undercoat layer is desirably about 0.05 μm to 0.5 μm.

In a case of coating the undercoat layer with the thermosensitive recording layer, the undercoat layer swells due to moisture contained in the coating liquid for a thermosensitive recording layer, and an image recorded on the thermosensitive recording layer deteriorates. Therefore, it is preferable to perform the hardening using dialdehydes such as glutaraldehyde and 2,3-dihydroxy-1,4-dioxane and a hardening agent such as boric acid in the undercoat layer. The amount of the hardening agent added can be appropriately selected within a range of 0.2 mass % to 3.0 mass % with respect to the total mass of the undercoat layer in accordance with the desired degree of hardening.

—Light Shielding Layer (Ultraviolet Filter Layer)—

In the thermosensitive recording material of the embodiment of the present invention, a light shielding layer may be provided in order to prevent ground fogging and fading of an image caused by light. The light shielding layer is obtained by homogeneously dispersing an ultraviolet absorbent in a binder. The discoloration of the ground or discoloration or fading of the image area caused by ultraviolet light is prevented by the homogeneously dispersed ultraviolet absorbent which effectively absorbs ultraviolet light. A method for producing a light shielding layer, compounds to be used, and the like disclosed in JP1992-197778A (JP-H4-197778A) and the like can be used in addition to a benzotriazole ultraviolet absorbent, a benzophenone ultraviolet absorbent, a hindered amine ultraviolet absorbent, and the like.

—Light Reflection Prevention Layer—

A light reflection prevention layer which contains fine particles having an average particle diameter of 1 μm to 20 μm, preferably 1 μm to 10 μm may be provided on a side of a surface (rear surface of a support) opposite to a surface of the support coated with a thermosensitive recording layer. By performing the coating with the thermosensitive recording layer, glossiness measured at an incident light angle of 20° is preferably less than or equal to 50% and more preferably less than or equal to 30%. Examples of the fine particles contained in the light reflection prevention layer include fine particles of copolymer resins such as a cellulose fiber, a polystyrene resin, an epoxy resin, a polyurethane resin, a urea formalin resin, a poly(meth)acrylate resin, a polymethyl(meth)acrylate resin, and vinyl chloride or vinyl acetate, fine particles of synthetic polymers such as polyolefin, and fine particles of inorganic substances such as calcium carbonate, titanium oxide, kaolin, smectite clay, aluminum hydroxide, silica, and zinc oxide, in addition to fine particles of starch or the like obtained from barley, wheat, corn, rice, and legumes. These particles may be used singly or in combination of two or more thereof. In addition, a particulate having a refractive index of 1.45 to 1.75 is preferable from the viewpoint of favorable transparency of the thermosensitive recording material.

(Support)

In the thermosensitive recording material of the embodiment of the present invention, it is preferable to use a transparent support in order to obtain a transparent thermosensitive recording material. The "transparency" refers to a property in which the ratio of the amount of light passing through the transparent support to the amount of light emitted from a light source is greater than or equal to 80%.

Examples of the support include polymer films such as a polyester film of polyethylene terephthalate, polybutylene terephthalate, or the like, a cellulose triacetate film, and a polyolefin film of polypropylene, polyethylene or the like.

The support may be used singly or in combination of two or more thereof.

A polyethylene terephthalate film is preferable as the support from the viewpoint of transparency.

A back layer may be provided in the support on a side where there is no thermosensitive recording layer.

Regarding the back layer, the disclosure in paragraph numbers [0128] to [0130] of JP1999-65021A (JP-H11-65021A).

In addition, a back protective layer may further provided on the back layer provided on the support.

The thickness of the support is preferably 25 μm to 250 μm and more preferably 50 to 200 μm.

The support (for example, a polymer film) may be colored in an arbitrary hue.

Examples of the method for coloring a synthetic polymer film include: a method for kneading a dye in a resin before molding a resin film, and molding a film; and a method for performing coating through well-known methods for preparing a coating liquid obtained by dissolving a dye in an appropriate solvent and coating the colorless and transparent resin film with the prepared coating liquid, for example, a gravure coating method, a roller coating method, and a wire coating method. Among them, a method for molding a polyester resin such as polyethylene terephthalate or polyethylene naphthalate, in which a blue dye is kneaded, into a film and performing heat resistant treatment, stretching treatment, and antistatic treatment thereon is preferable.

Particularly, in a case where the thermosensitive recording material of the embodiment of the present invention is observed on Schaukasten from the support side, in some cases, it is difficult to recognize since dazzling occurs due to light of Schaukasten transmitting a transparent non-image area. In order to avoid this phenomenon, it is particularly preferable to use a synthetic polymer film which is colored in blue within a rectangular region formed by four points of A (x=0.2805, y=0.3005), B (x=0.2820, y=0.2970), C (x=0.2885, y=0.3015), and D (x=0.2870, y=0.3040) on chromaticity coordinates defined by a method disclosed in JIS-Z8701, as the transparent support.

In addition, a back coat layer may be provided on a side where no thermosensitive recording layer of the support provided.

<Method for Manufacturing Thermosensitive Recording Material>

The thermosensitive recording material of the embodiment of the present invention described above is not particularly limited as long as the method for manufacturing a thermosensitive recording material by providing a thermosensitive recording layer and a protective layer as described above is used, and it is possible to manufacture the thermosensitive recording material of the embodiment of the present invention by selecting well-known manufacturing methods.

Among them, the thermosensitive recording material of the embodiment of the present invention is preferably manufactured by a method (a method for manufacturing a thermosensitive recording material of the embodiment of the present invention) which includes: forming a thermosensitive recording layer containing a polyvinyl alcohol and a color development component on a support through coating (hereinafter, also referred to as a thermosensitive recording layer formation step); forming a protective layer containing a resin component on the thermosensitive recording layer formed on the support through coating (hereinafter, also referred to as a protective layer formation step); and subjecting at least the thermosensitive recording layer and the protective layer to heat treatment after the formation of the protective layer (hereinafter, also referred to as a heat treatment step), in which at least one of the thermosensitive recording layer or the protective layer further contains a styrene-isoprene resin, and the temperature range of the heat treatment is set to be greater than or equal to the highest glass transition point (Tg; hereinafter, abbreviated as "Tg") of the styrene-isoprene resin and less than or equal to a color development temperature of the thermosensitive recording layer.

—Thermosensitive Recording Layer Formation Step—

The method for manufacturing a thermosensitive recording material of the embodiment of the present invention includes forming a thermosensitive recording layer containing a polyvinyl alcohol and a color development component on a support through coating (thermosensitive recording layer formation step).

The details of the component contained in a coating liquid for forming a thermosensitive recording layer are as described above.

—Protective Layer Formation Step—

The method for manufacturing a thermosensitive recording material of the embodiment of the present invention includes further forming a protective layer containing a resin component on the thermosensitive recording layer formed on the support through coating (protective layer formation step).

The details of the component contained in a coating liquid for forming a protective layer are as described above.

Humidity of at least the thermosensitive recording layer and the protective layer may be controlled before heat treatment to be described below and after the formation of the protective layer. By controlling the humidity, it is possible to make the layers contain moisture. Accordingly, there is an effect of further suppressing generation of image streaks easily caused by the heat treatment.

The controlling of humidity is preferably performed under environmental conditions of a temperature of 10° C. to 40° C. and a relative humidity of greater than or equal to 50%, and more preferably performed under environmental conditions of a temperature of greater than or equal to 15° C. and less than 35° C. and a relative humidity of greater than or equal to 60% and less than 90%. The time for controlling humidity varies depending on the composition, the temperature, and the humidity of the thermosensitive recording layer and the protective layer, and is preferably within a range of 30 seconds to 200 seconds.

The method for manufacturing a thermosensitive recording material of the embodiment of the present invention preferably includes controlling humidity of at least the thermosensitive recording layer and the protective layer after the formation of the protective layer and before the heat treatment (humidity controlling step).

—Heat Treatment Step—

The method for manufacturing a thermosensitive recording material of the embodiment of the present invention includes subjecting at least the thermosensitive recording layer and the protective layer to heat treatment after the formation of the protective layer (heat treatment step).

In the heat treatment step, subjecting a coating film to heat treatment at a temperature higher than or equal to the highest Tg of a styrene-isoprene resin after the coating and the drying, for thermal fusion (thermal fusion step) is provided. In this case, the temperature of the heat treatment is set to be lower than or equal to a color development temperature of the thermosensitive recording layer in order to prevent the color development of a color development component.

The temperature of the surface of each layer, heating temperature during the heat treatment, is preferably higher than or equal to 50° C. and lower than 130° C., more preferably higher than or equal to 60° C. and lower than 120° C., and still more preferably higher than or equal to 80° C. and lower than 120° C. from the viewpoints of improving the strength and the adhesive force of the film surfaces and preventing a color development reaction from occurring.

Furthermore, a case is particularly preferably in which the heat treatment is performed at a temperature of higher than or equal to 50° C. and lower than 130° C. after the humidity is controlled to be greater than or equal to 50%.

The method for manufacturing a thermosensitive recording material of the embodiment of the present invention may further include forming another layer such as an interlayer or an undercoat layer as another layer in addition to the thermosensitive recording layer and the protective layer (another layer formation step).

In a case where the method for manufacturing a thermosensitive recording material of the embodiment of the present invention includes forming an interlayer (interlayer formation step), the density of a polyvinyl alcohol in a coating liquid for an interlayer to be used for forming the interlayer is preferably 3 mass % to 25 mass %, and more preferably about 5 mass % to 15 mass %. In addition, the dry coating amount of the coating liquid for an interlayer is preferably 0.2 g/m$^2$ to 6 g/m$^2$, and more preferably 0.5 g/m$^2$ to 3 g/m$^2$.

In the method for manufacturing a thermosensitive recording material of the embodiment of the present invention, an undercoat layer, a thermosensitive recording layer, an interlayer, and a protective layer may be applied and formed on a support in this order from the support side.

The coating is performed through well-known coating methods such as a blade coating method, an air knife coating method, a gravure coating method, a roll coating method, a spray coating method, a dip coating method, and a bar coating method.

In addition, examples of the method of performing simultaneous multilayer coating on a plurality of layers include an extrusion die method. Specifically, it is possible to appropriately select various coating operations including extrusion coating, slide coating, curtain coating, dip coating, knife coating, flow coating, or extrusion coating in which the types of hoppers disclosed in U.S. Pat. No. 2,681,294A are used. Among them, extrusion coating or slide coating disclosed in "LIQUID FILM COATING" (published by CHAPMAN & HALL, 1997) pp. 399 to 536 written by Stephen F. Kistler, Peter M. Schweizer is preferable, and slide coating is particularly preferable.

Examples of the shape of a slide coater used for slide coating are disclosed in FIG. 11*b*. 1 in p. 427 of the same literature. In addition, it is possible to form two or more layers through methods disclosed in pp. 399 to 536 of the same literature or through methods disclosed in U.S. Pat. No. 2,761,791A and GB837,095B.

~Thermal Head~

The thermal head used in a case of recording an image on the thermosensitive recording material of the embodiment of the present invention is not particularly limited, and a thermal head may be used in which a protective layer is provided in a heating element including a heating resistor and an electrode on a glaze layer using a known film forming device disclosed in JP2003-94826A so that the carbon proportion of the uppermost layer in contact with the thermosensitive recording material becomes greater than or equal to 90%. Alternatively, a thermal head having a usual silicon nitride as a main body may be used.

EXAMPLES

Hereinafter, the embodiment of the present invention will be more specifically described using specific examples. However, the embodiment of the present invention is not limited to the following examples within the scope not departing from the gist thereof. Unless otherwise specified, "parts" are on a mass basis.

In the examples, the "average particle diameter" of a pigment is a 50% volume-average particle diameter which is an average particle diameter of pigment particles and corresponds to 50% volume of total pigments, and the 50% volume-average particle diameter is measured through the following method.

That is, pigments were dispersed in the coexistence of a dispersing auxiliary, water was added to the pigment dispersion immediately after the dispersion, and a liquid to be tested which was diluted to 0.5 mass % was added to warm water at 40° C. to adjust the light transmittance to 75±1.0%. After performing ultrasonic treatment for 30 seconds, the 50% volume-average particle diameter was measured using a laser diffraction particle size distribution measurement device LA700 (trade name: LA700 manufactured by HORIBA, Ltd.).

Hereinafter, all of the "average particle diameter" represent an average particle diameter measured through the same method.

In addition, the notation "-" in Table 1 indicates that the component is not included.

Example 1

[Preparation of Coating Liquid A for Protective Layer]

—Preparation of Pigment Dispersion Liquid for Protective Layer—

30 g of stearic acid-treated aluminum hydroxide (trade name: HIGILITE H42S manufactured by SHOWA DEKKO K.K.) was added to 110 g of water as a pigment and the mixture was stirred for 3 hours. Then, 0.8 g of a dispersing auxiliary (trade name: POIZ 532A manufactured by Kao Corporation), 30 g of a 10 mass % aqueous solution of a polyvinyl alcohol (trade name: PVA-105 manufactured by KURARAY CO., LTD.), and 10 g of an aqueous solution of a compound represented by Structural Formula [100] which was adjusted to 2 mass % were added thereto, and the mixture was dispersed using a sand mill to obtain a pigment dispersion liquid for a protective layer having an average particle diameter of 0.30 μm.

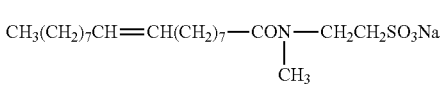

[100]

—Preparation of Coating Liquid A for Protective Layer—

A coating liquid A for a protective layer was obtained by mixing components in the following composition.

| <Composition> | |
|---|---|
| 6 mass % aqueous solution of polyvinyl alcohol (Trade name: GOHSENX Z410, acetoacetyl modified PVA manufactured by Nippon Synthetic Chemical Industry Co., Ltd.) | 1,000 g |
| 20.5 mass % dispersion of Zinc stearate (Trade name: F-115 manufactured by CHUKYO YUSHI CO., LTD.) | 10 g |
| 21.5 mass % stearic acid amide compound (Trade name: G-270 manufactured by CHUKYO YUSHI CO., LTD.) | 38 g |
| 18.0 mass % stearic acid (Trade name: SELOSOL 920 manufactured by CHUKYO YUSHI CO., LTD.) | 11 g |
| 4 mass % aqueous solution of boric acid | 10 g |
| 50 mass % aqueous solution of glyoxal | 1 g |
| Above-described pigment dispersion liquid for protective layer (pigment concentration: 18 mass %) | 169 g |

-continued

| <Composition> | |
|---|---|
| 35 mass % silicone oil aqueous dispersion liquid (Polydimethylsiloxane; BY22-840 manufactured by Dow Corning Toray Co., Ltd.) | 20 g |
| 10 mass % aqueous solution dodecyl benzenesulfonic acid sodium salt | 7 g |
| 75 mass % solution of ammonium salt of di-2-ethylhexyl sulfosuccinic acid (Nissan Elektor SAL 1 manufactured by NOF CORPORATION) | 3 g |
| 6 mass % aqueous solution of styrene-maleic acid copolymer ammonium salt (Trade name: POLYMARON 385 manufactured by Arakawa Chemical Industries, Ltd.) | 18 g |
| 20 mass % colloidal silica (Trade name: SNOWTEX manufactured by NISSAN CHEMICAL INDUSTRIES, LTD.) | 25 g |
| 10 mass % SURFLON S231W (manufactured by SEIMI CHEMICAL CO., LTD.) | 16 g |
| PLYSURF A217 (manufactured by DKS Co. Ltd.) | 1 g |
| 2 mass % acetic acid | 8 g |
| Water | 10 g |

[Preparation of Coating Liquid for Thermosensitive Recording Layer]

As shown below, a microcapsule liquid in which a color development component was encapsulated through emulsification and a developer solid dispersion liquid which contains a developer dispersed through solid-dispersing (beads mill) are prepared.

—Preparation of Microcapsule Liquid A—

Compounds (color development components) represented by Structural Formulas [201] to [207] in amounts shown below were added to 24.3 g of ethyl acetate as a color developer, and the mixture was heated to 70° C., dissolved, and then, cooled to 45° C. 13.1 g of a capsule wall material (trade name: TAKENATE D140N manufactured by Takeda Pharmaceutical Company Limited.) and 2.3 g of BURNOCK D750 (manufactured by DIC CORPORATION) were added to the solution after the cooling, and the mixture was mixed with each other to obtain an oil phase. The obtained oil phase was added to a water phase obtained by mixing 48 g of an 8 mass % aqueous solution of a polyvinyl alcohol (trade name: PVA-217 manufactured by KURARAY CO., LTD.) and a compound represented by Structural Formula [307] into 16 g of water, and then, emulsification was performed for 5 minutes at a rotation speed of 15,000 rpm using ACE HOMOGENIZER (manufactured by NISSEI Corporation).

After further adding 110 g of water and 1.0 g of tetraethylenepentamine to the obtained emulsion liquid, an encapsulation reaction was performed for 4 hours at 60° C., and a microcapsule liquid A (concentration of solid contents: 23 mass %) containing microcapsules having an average particle diameter of 0.35 μm was prepared.

[307]

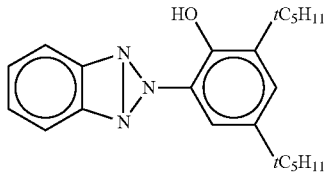

Compound represented by Structural Formula [201] . . . 11.7 g

Compound represented by Structural Formula [202] . . . 1.5 g

Compound represented by Structural Formula [203] . . . 2.2 g

Compound represented by Structural Formula [204] . . . 5.65 g

Compound represented by Structural Formula [205] . . . 1.2 g

Compound represented by Structural Formula [206] . . . 1.1 g

Compound represented by Structural Formula [207] . . . 0.57 g

[201]

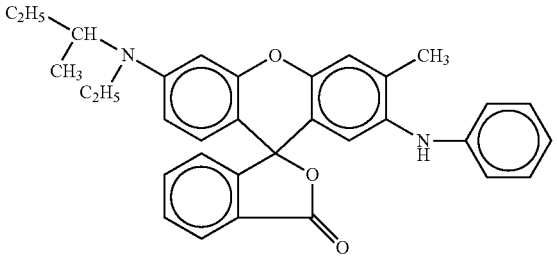

[202]

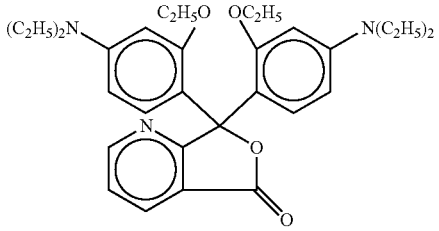

[203]

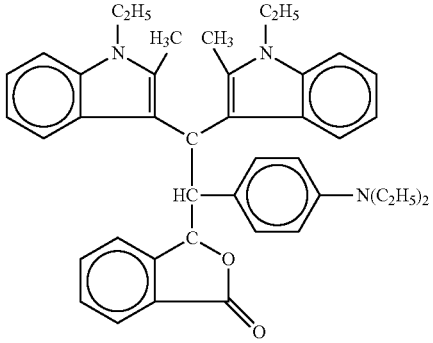

[204]

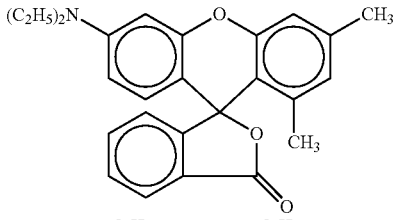

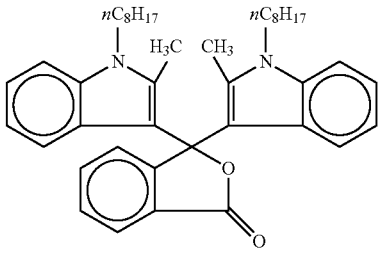

-continued

[206]

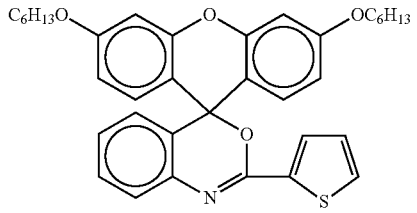

[207]

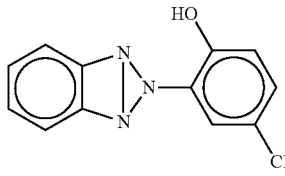

—Preparation of Developer Solid Dispersion Liquid—

Compounds represented by Structural Formulas [301] to [306] in amounts shown below were added to a water phase obtained by mixing 380 g of water and 100 g of a 10 mass % aqueous solution of a polyvinyl alcohol (trade name: MP203 manufactured by KURARAY CO., LTD.) with each other, as a developer. Thereafter, dispersion treatment was performed under the following conditions using a beads mill disperser (WAB DYN O-MILL KDL PILOT type, manufactured by Shinmaru Enterprise Corporation), and was then finished in a case where the particle size of the dispersed developer reached 0.6 μm. In this manner, a developer solid dispersion liquid (concentration of solid contents: 25 mass %) was prepared.

<Conditions>

Beads type: unibead (soda-lime glass, bead diameter of 0.5 μm to 0.7 μm)

Filling rate of beads: 80%

Rotational peripheral speed: 14 m/sec

Flow rate: 0.5 Kg/min

Compound represented by Structural Formula [301] . . . 22 g

Compound represented by Structural Formula [302] . . . 8 g

Compound represented by Structural Formula [303] . . . 3 g

Compound represented by Structural Formula [304] . . . 3 g

Compound represented by Structural Formula [305] . . . 0.9 g

Compound represented by Structural Formula [306] . . . 0.9 g (PIONIN A-43-S (surfactant) manufactured by TAKEMONO OIL & FAT Co., Ltd.)

[301]

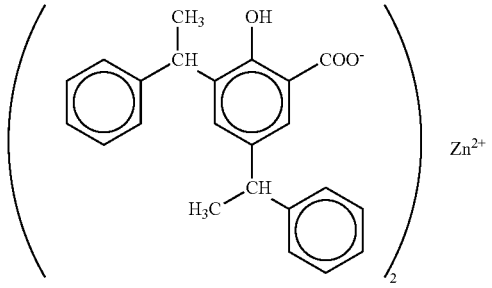

-continued

[302]

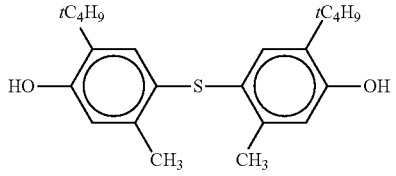

[303]

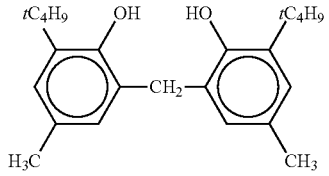

[304]

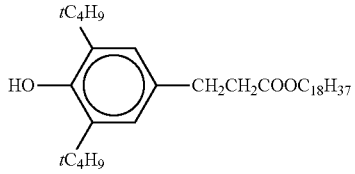

[305]

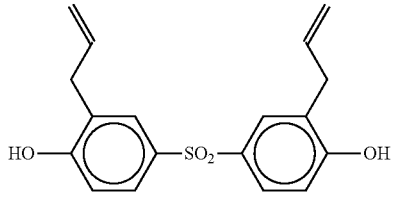

[306]

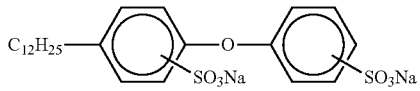

—Preparation of Coating liquid A for Thermosensitive Recording Layer—

Components of the following composition were mixed with each other to prepare a coating liquid A for a thermosensitive recording layer.

| <Composition> | |
|---|---|
| Above-described developer solid dispersion liquid | 293 g |
| Above-described microcapsule liquid A | 70 g |
| 50 mass % aqueous solution of glyoxal | 18 g |
| Styrene-isoprene latex (abbreviated as SIR in Table 1) (LX464PX manufactured by ZEON CORPORATION; isoprene copolymer, concentration of solid contents: 40 mass %) | 100 g |
| Colloidal silica (SNOWTEX (concentration of solid contents: 20 mass %) manufactured by NISSAN CHEMICAL INDUSTRIES, LTD.) | 142 g |

The glass transition temperature (Tg) of styrene-isoprene latex (LX464PX) used above was measured using a differential scanning calorimeter (DSC) EXSTAR 6220 manufactured by SII Nanotechnology Inc. As a result, the styrene-isoprene latex had two Tg's of 23° C. (Tg 1) on a low temperature side and 57° C. (Tg 2) on a high temperature side.

—Preparation of Coating Liquid B for Thermosensitive Recording Layer (for Comparison)—

Components of the following composition were mixed with each other to prepare a coating liquid B for a thermosensitive recording layer.

| | |
|---|---|
| Above-described developer solid dispersion liquid | 293 g |
| Above-described microcapsule liquid A | 70 g |
| 50 mass % aqueous solution of glyoxal | 18 g |
| Styrene-isoprene latex (Concentration of solid contents: 41 mass %, PATERACOL H2020A manufactured by DIC CORPORATION; abbreviated as SBR in Table 1) | 100 g |
| Colloidal silica (SNOWTEX (concentration of solid contents: 20 mass %) manufactured by NISSAN CHEMICAL INDUSTRIES, LTD.) | 142 g |

—Preparation of Coating Liquid C for Thermosensitive Recording Layer (for Comparison)—

Components of the following composition were mixed with each other to prepare a coating liquid C for a thermosensitive recording layer.

| | |
|---|---|
| Above-described developer solid dispersion liquid | 293 g |
| Above-described microcapsule liquid A | 70 g |
| 50 mass % aqueous solution of glyoxal | 18 g |
| Urethane resin latex (Concentration of solid contents: 41 mass %, PATERACOL H2020A manufactured by DIC CORPORATION;) | 100 g |
| Colloidal silica (SNOWTEX-O (concentration of solid contents: 20 mass %) manufactured by NISSAN CHEMICAL INDUSTRIES, LTD.) | 142 g |

—Preparation of Coating Liquid D for Thermosensitive Recording Layer (for Comparison)—

Components of the following composition were mixed with each other to prepare a coating liquid D for a thermosensitive recording layer.

| | |
|---|---|
| Above-described developer solid dispersion liquid | 293 g |
| Above-described microcapsule liquid A | 70 g |
| 50 mass % aqueous solution of glyoxal | 18 g |
| 8 mass % aqueous solution of polyvinyl alcohol (Trade name: PVA-217 manufactured by KURARAY CO., LTD.) | 100 g |
| Colloidal silica (SNOWTEX-O (concentration of solid contents: 20 mass %) manufactured by NISSAN CHEMICAL INDUSTRIES, LTD.) | 142 g |

[Preparation of Coating Liquid A for InterLayer]

Components of the following composition were mixed with each other to prepare a coating liquid for an interlayer.

| <Composition> | |
|---|---|
| PVA-124C (Polyvinyl alcohol, polymerization degree: 2400, manufactured by KURARAY CO., LTD.) | 100 g |
| Sodium bis (3,3,4,4,5,5,6,6,6-nonafluorohexyl) = 2-sulfinatooxy succinate (Concentration of solid contents: 1 mass % manufactured by Fujifilm Fine Chemicals Co., Ltd.) | 40 g |
| Sodium dodecyl benzene sulfonate (concentration of solid contents: 72 mass %) | 24 g |
| Surfynol 104E (Concentration of solid contents: 50 mass %, manufactured by Nissin Chemical Co., Ltd.) | 26 g |
| Sodium 4-{2-{2-(2-tetradecyloxy-ethoxy)-ethoxy}-ethoxy}-butane-1-sulfonate (concentration of solid contents: 10 mass %) | 8 g |
| Water | 1800 g |

[Preparation of Coating Liquid for BC Layer (Back Layer)]

Components of the following composition were mixed with each other, and a coating liquid for a back layer was prepared by adding water to the mixture so that the total amount of the mixture becomes 62.77 L.

| <Composition> | |
|---|---|
| Lime-treated gelatin | 1,000 g |
| 12 mass % of matte agent (polymethyl methacrylate (PMMA) spherical particles having average particle diameter of 5.7 μm) and gelatin dispersion containing gelatin | 757 g |
| Ultraviolet absorber emulsion containing compound represented by Structural Formulas [501] to [505] | 3,761 g |

The content of the ultraviolet absorber per 1,000 g of ultraviolet absorber emulsion is shown below.

| | |
|---|---|
| Compound represented by Structural Formula [501] | 9.8 g |
| Compound represented by Structural Formula [502] | 8.4 g |
| Compound represented by Structural Formula [503] | 9.8 g |
| Compound represented by Structural Formula [504] | 13.9 g |
| Compound represented by Structural Formula [505] | 29.3 g |
| 1,2-benzisothiazolin-3-one | 1.75 g |
| Poly(sodium p-vinylbenzenesulfonate) (Molecular weight: about 400,000) | 64.2 g |
| Compound represented by Structural Formula [506] | 10.0 g |
| Latex of polyethyl acrylate (concentration of solid contents: 20 mass %) | 3,180 ml |
| N,N-ethylene-bis (vinylsulfonylacetamide) | 75.0 g |
| 1,3-bis (vinylsulfonylacetamide)propane | 25.0 g |
| Water | remaining amount (g) necessary for preparing 62.77 liters of coating liquid for back layer |

[501]

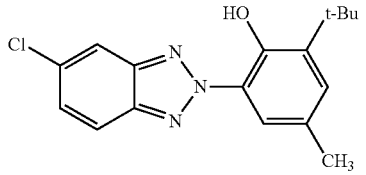

[502]

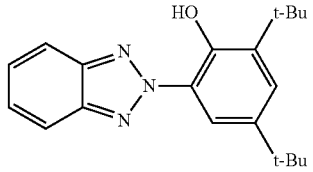

[503]

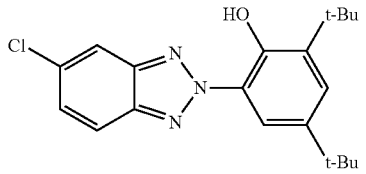

-continued

[504]

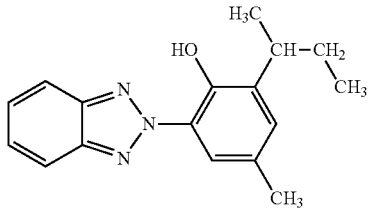

[505]

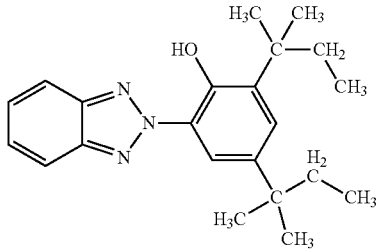

[506]

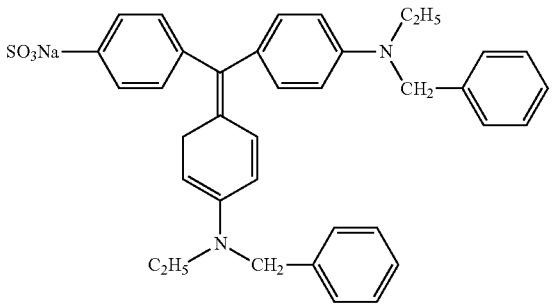

[Preparation of Coating Liquid for BPC Layer (Back Protective Layer)]

Components of the following composition were mixed with each other, and the pH value was adjusted to 7.0 with caustic soda, and then water was added thereto so that the total amount was 66.79 liters to prepare a coating liquid for a back protective layer.

| <Composition> | |
|---|---|
| Lime-treated gelatin | 1,000 g |
| 15 mass % of matte agent (polymethyl methacrylate (PMMA) spherical particles having average particle diameter of 0.70 μm) and gelatin dispersion containing gelatin | 2,000 g |
| Methanol | 1,268 ml |
| 1,2-benzisothiazolin-3-one | 1.75 g |
| Sodium polyacrylate (molecular weight: about 100,000) | 64.4 g |
| Poly (sodium p-vinylbenzenesulfonate) (Molecular weight: about 400,000) | 54.0 g |
| Sodium p-t-octylphenoxypolyoxyethylene-ethylsulfonate | 25.2 g |
| N-propyl-N-polyoxyethylene-perfluorooctane-sulfonic acid amide sodium butylsulfonate | 5.3 g |
| Potassium perfluorooctanesulfonate | 7.1 g |
| Water | remaining amount (g) necessary for preparing 66.79 liters of coating liquid for back protective layer |

[Production of Support]

Each of the coating liquid for a BC layer and the coating liquid for a BPC layer prepared above were subjected to simultaneous multilayer coating through a slide bead method on a transparent polyethylene terephthalate (PET) support (with a thickness of 175 μm), which was subjected to blue staining at x=0.2850 and y=0.2995 at chromaticity coordinates defined in Japanese Industrial Standard (JIS-Z8701), in this order from the PET support, and were dried. Electric charge of the PET support was previously eliminated by applying ionic air before the coating. The coating conditions and the drying conditions are as follows.

<Conditions>

Coating amount of coating liquid for BC layer: 44.0 ml/m$^2$

Coating amount of coating liquid for BPC layer: 18.5 ml/m$^2$

Coating speed: 160 m/minute

Gap between coating die distal end and PET support: 0.10 mm to 0.30 mm

Pressure of the decompression chamber: set to be 196 Pa to 882 Pa lower than atmospheric pressure Subsequently, the PET support was transported to a cooling zone, the coating film was cooled with air at a dry-bulb temperature of 10° C. to 20° C. Thereafter, the coating film was transported without contact, and dried by applying dry air at a dry-bulb temperature of 23° C. to 45° C. and a wet-bulb temperature of 15° C. to 21° C. using a helical non-contact type drying device.

Example 1

—Production of Thermosensitive Recording Material—

Each of the coating liquid A for a thermosensitive recording layer, the coating liquid A for an interlayer, and the coating liquid A for a protective layer were subjected to simultaneous multilayer coating through a slide bead method on the surface of the support coated with the above-described BC layer and BPC layer on a side opposite to the surface coated with the BC layer and the BPC layer so that the coating amounts of the layers respectively become 85 ml/m$^2$, 20 ml/m$^2$, and 44 ml/m$^2$ (coating step: thermosensitive recording layer formation step, interlayer formation step, and protective layer formation step), and dried to obtain a transparent thermosensitive recording material having the thermosensitive recording layer, the interlayer, and the protective layer from the support side.

The coating conditions and the drying conditions are as follows.

The coating speed was set to 160 m/minute, the gap between the coating die distal end and the support was 0.10 to 0.30 mm, and the pressure of the decompression chamber was set to be 196 Pa to 882 Pa lower than the atmospheric pressure. Electric charge of the support was previously eliminated by applying ionic air before the coating.

Subsequently, the support after the coating was transported to a first drying zone, and initial drying was performed with air at a dry-bulb temperature of 40° C. to 60° C., a dew point of 0° C., and a film surface air speed of lower than or equal to 5 m/sec. Thereafter, the support was transported without contact, and dried by controlling the film surface temperature to 18° C. to 23° C. with dry air at a dry-bulb temperature of 23° C. to 45° C. and a relative humidity of 20% to 70%, a film surface air saponification degree of 15 m/sec to 25 m/sec using a helical non-contact type drying device (drying step).

Thereafter, the support was passed through a humidity controlling zone at a temperature of 25° C. and a relative humidity of 80% (humidity controlling step), and was then passed through a heating zone in which heat treatment was performed by heating the support so that the film surface temperature becomes 90° C. (heat treatment step), the process was completed by winding the support under the conditions of a temperature of 25° C. and a relative humidity of 60° C.

In the solid content of the protective layer, the content of di-2-ethylhexyl sulfosuccinic acid ammonium salt was 7.2 mass %.

—Image Recording—

An image sample was produced through color development by applying a head pressure of 10 kg/cm$^2$ and a recording energy of 85 mJ/mm$^2$ using a thermal head (trade name: KGT, 358-12PAN22 manufactured by Kyocera Corporation). Thereafter, the following evaluation was performed. The evaluation results are shown in Table 1.

—Evaluation—

<Color Development Efficiency>

The maximum value of the transmitted optical density (Dmax) was measured with a visual filter using Macbeth TD904. A value obtained by dividing the measured value Dmax by the weight g (unit: gram) per 1 m$^2$ of a leuco dye was set as a color development efficiency (Dmax/g).

According to the following evaluation criteria, the value of the color development efficiency was evaluated by indicating the superiority (good: 5→inferior: 1) in five steps in order of the highest value. In the evaluation results, 3 or more points are in practically acceptable levels.

<Evaluation Criteria>

5: Color development efficiency (Dmax/g) is greater than or equal to 1.0.

4: Color development efficiency (Dmax/g) is greater than or equal to 0.9 and less than 1.0.

3: Color development efficiency (Dmax/g) is greater than or equal to 0.8 and less than 0.9.

2: Color development efficiency (Dmax/g) is greater than or equal to 0.7 and less than 0.8.

1: Color development efficiency (Dmax/g) is less than 0.7.

<Printing Streaks>

A thermosensitive recording material was cut into 25 cm×20 cm to prepare a sample piece. The sample piece was set so that the short-length direction of the sample piece was perpendicular to the width direction of the thermal head, and continuous printing of 10,000 sheets was performed. The printing was performed under conditions of a head pressure of 10 kg/cm$^2$ and a recording energy of 85 mJ/mm$^2$ using a thermal head (trade name: KGT, 358-12PAN22 manufactured by Kyocera Corporation).

In a case where abrasion of a thermal head and contamination on the head occur during the continuous printing, clear white streak-like streak failures can be detected. According to the following evaluation criteria, the streak failures were evaluated by indicating the superiority (good: 5→inferior: 1) in five steps in order of the slowest occurrence timing of the streak failures. In the evaluation results, 3 or more points are in practically acceptable levels.

<Evaluation Criteria>

5: Printing streaks do not occur even in a case where 10,000 sheets are printed.

4: The occurrence of printing streaks can be checked during the printing of greater than 5,000 sheets and less than 10,000 sheets.

3: Printing streaks do not occur even in a case where 5,000 sheets are printed.

2: The occurrence of printing streaks can be checked during the printing of greater than 100 sheets and less than 5,000 sheets.

1: Printing streaks occur even in a case where 100 sheets are printed.

<Yellowing of Image>

An image was exposed to light of a fluorescent lamp with 1,000 Lux for 7 days in an environment of a temperature of 25° C. and a relative humidity of 60%. The change in a yellowish tint was visually checked as degree of yellowing of the image.

According to the following evaluation criteria, the change in the yellowish tint was evaluated by indicating the superiority (good: 5→inferior: 1) in five steps in order of the smallest change in the yellowish tint. In the evaluation results, 3 or more points are in practically acceptable levels.

<Evaluation Criteria>

5: No change in a yellowish tint was checked even at a point in time of day 7.

4: Significantly slight change in a yellowish tint was checked at a point in time of day 7.

3: Slight change in a yellowish tint was checked at a point in time of day 7.

2: Clear change in a yellowish tint was checked at a point in time of day 7.

1: Clear change in a yellowish tint was checked at a point in time before day 7.

<Adhesiveness>

Two thermosensitive recording materials were prepared and superposed so that the surface (front surface) on a side on which a thermosensitive recording layer and the like are formed and the surface (rear surface) on a side opposite to the front surface face each other, and 800 g/5 cm$^2$ of a load was applied. The thermosensitive recording materials were allowed to stand for 10 days in an environment of a temperature of 40° C. and a relative humidity of 80% while being in a loaded state. The two thermosensitive recording materials were peeled off after being allowed to stand. At this time, the change in the adhesion area was evaluated by indicating the superiority (good: 5→inferior: 1) in five steps in order of the smallest adhesive area. In the evaluation results, 3 or more points are in practically acceptable levels.

<Evaluation Criteria>

5: In a case where the peeling was performed with one thermosensitive recording material, there was no adhesive surface, and the peeling was smoothly performed.

4: In a case where the peeling was performed with one thermosensitive recording material, there was almost no adhesive surface, and the peeling was smoothly performed.

3: In a case where the peeling was performed with one thermosensitive recording material, there was an adhesive surface, but the peeling was smoothly performed.

2: In a case where the peeling was performed with one thermosensitive recording material, there was an adhesive surface, and it was difficult to perform the peeling.

1: In a case where the peeling was performed with one thermosensitive recording material, most of the surface adhered to each other, and it was difficult to perform the peeling.

Examples 2 to 20 and Comparative Examples 1 to 5

Thermosensitive recording materials were produced similarly to Example 1 except that the composition in a thermosensitive recording layer, an interlayer, and a protective layer and the presence or absence of heat treatment in Example 1 were changed as shown in Table 1, and evaluation was performed. The evaluation results are shown in Table 1.

The details of the components in the column of the protective layer in Table 1 are above-described follows.

SIR: Styrene-isoprene latex (LX464PX manufactured by ZEON CORPORATION; styrene-isoprene copolymer, concentration of solid contents: 40 mass %)

Urethane: Urethane resin latex (concentration of solid contents: 41 mass %, PATERACOL H2020A manufactured by DIC CORPORATION)

SBR: Styrene butadiene resin latex (concentration of solid contents: 41 mass %, PATERACOL H2020A manufactured by DIC CORPORATION)

Adipic acid dihydrazide: ADH-35 manufactured by Otsuka Chemical Co., Ltd.

Oxazole: manufactured by Tokyo Chemical Industry Co., Ltd.

PVA: 8 mass % aqueous solution of polyvinyl alcohol (trade name: PVA-217 manufactured by KURARAY CO., LTD.)

TABLE 1

| | Support | | Thermosensitive recording layer | | | | | | | | | | Intermediate layer | |
|---|---|---|---|---|---|---|---|---|---|---|---|---|---|---|
| | | | | Resin 1 | | | Resin 2 | | Color development component (first component) | Developer (second component) | Cross-linking agent glyoxal | | Resin | |
| | Type | Thickness [μm] | Coating liquid | Type | Amount (g/m²) | Tg | Type | Amount (g/m²) | Amount (g/m²) | Amount (g/m²) | | Thickness [μm] | Type | Amount (g/m²) |
| Example 1 | PET | 175 | A | SIR | 7.6 | Two | PVA | 2 | 3.24 | 7.3 | Present | 18.0 | PVA | 2 |
| Example 2 | PET | 175 | A | SIR | 7.6 | Two | PVA | 2 | 3.24 | 7.3 | Present | 18.0 | PVA | 2 |
| Example 3 | PET | 175 | A | SIR | 7.6 | Two | PVA | 2 | 3.24 | 7.3 | Present | 18.0 | PVA | 2 |
| Example 4 | PET | 175 | A | SIR | 7.6 | Two | PVA | 2 | 3.24 | 7.3 | Present | 18.0 | None | 0 |
| Example 5 | PET | 175 | A | SIR | 7.6 | Two | PVA | 2 | 3.24 | 7.3 | Present | 18.0 | PVA | 2 |
| Example 6 | PET | 175 | A | SIR | 7.6 | Two | PVA | 2 | 3.24 | 7.3 | None | 18.0 | PVA | 2 |
| Example 7 | PET | 175 | A | SIR | 5.6 | Two | PVA | 4 | 3.24 | 7.3 | Present | 18.0 | PVA | 2 |
| Example 8 | PET | 175 | A | SIR | 7.6 | Two | PVA | 2 | 3.24 | 7.3 | Present | 18.0 | None | 0 |
| Example 9 | PET | 175 | A | SBR | 7.6 | One | PVA | 2 | 3.24 | 7.3 | Present | 18.0 | None | 0 |
| Example 10 | PET | 175 | A | SIR | 7.6 | Two | PVA | 2 | 3.24 | 7.3 | Present | 18.0 | None | 0 |
| Example 11 | PET | 175 | A | SIR | 7.6 | Two | PVA | 2 | 3.24 | 7.3 | Present | 18.0 | PVA | 2 |
| Example 12 | PET | 175 | A | SIR | 7.6 | Two | PVA | 2 | 3.24 | 7.3 | None | 18.0 | PVA | 2 |
| Example 13 | PET | 175 | A | SIR | 7.6 | Two | PVA | 2 | 3.24 | 7.3 | Present | 18.0 | PVA | 2 |
| Example 14 | PET | 175 | A | SIR | 7.6 | Two | PVA | 2 | 3.24 | 7.3 | Present | 18.0 | PVA | 2 |
| Example 15 | PET | 175 | A | SIR | 7.6 | Two | PVA | 2 | 3.24 | 7.3 | Present | 18.0 | None | 0 |
| Example 16 | PET | 175 | A | SIR | 7.6 | Two | PVA | 2 | 3.24 | 7.3 | Present | 18.0 | None | 0 |
| Example 17 | PET | 175 | B | SBR | 7.6 | One | PVA | 2 | 3.24 | 7.3 | Present | 18.0 | None | 0 |
| Example 18 | PET | 175 | A | SIR | 7.6 | Two | PVA | 2 | 3.24 | 7.3 | Present | 18.0 | None | 0 |
| Example 19 | PET | 175 | A | SIR | 7.6 | Two | PVA | 2 | 3.24 | 7.3 | Present | 18.0 | None | 0 |
| Example 20 | PET | 175 | A | SIR | 7.6 | Two | PVA | 2 | 3.24 | 7.3 | Present | 18.0 | PVA | 2 |
| Comparative Example 1 | PET | 175 | C | Urethane | 7.6 | One | PVA | 2 | 4.36 | 7.3 | — | 18.0 | None | 0 |
| Comparative Example 2 | PET | 175 | C | Urethane | 7.6 | One | PVA | 2 | 3.24 | 7.3 | — | 18.0 | None | 0 |
| Comparative Example 3 | PET | 175 | C | Urethane | 7.6 | One | PVA | 2 | 4.36 | 7.3 | — | 18.0 | PVA | 2 |
| Comparative Example 4 | PET | 175 | D | PVA | 7.6 | One | — | — | 3.24 | 7.3 | — | 18.0 | None | 0 |
| Comparative Example 5 | PET | 175 | B | SBR | 7.6 | One | PVA | 2 | 3.24 | 7.3 | — | 18.0 | None | 0 |

| | Protective layer | | | | | Step Present or None of heat treatment after coating and drying | Color development efficiency | Printing streak | Yellowing | Adhesion |
|---|---|---|---|---|---|---|---|---|---|---|
| | Resin 1 | | | | | | | | | |
| | Type | Tg | Resin 2 | Cross-linking agent | Thickness [μm] | | | | | |
| Example 1 | — | — | Modified PVA | Glyoxal borate | 3.8 | Present | 5 | 5 | 5 | 5 |
| Example 2 | — | — | Modified PVA | — | 3.8 | Present | 5 | 5 | 5 | 4 |
| Example 3 | SIR | Two | Modified PVA | Glyoxal borate | 3.8 | Present | 4 | 5 | 5 | 4 |
| Example 4 | SIR | Two | Modified PVA | Glyoxal borate | 3.8 | Present | 4 | 4 | 5 | 4 |
| Example 5 | — | — | Modified PVA | Adipic acid dihydrazide and oxazole | 3.8 | Present | 5 | 5 | 3 | 5 |
| Example 6 | — | — | Modified PVA | Adipic acid dihydrazide and oxazole | 3.8 | Present | 5 | 4 | 3 | 5 |
| Example 7 | — | — | Modified PVA | Glyoxal borate | 3.8 | Present | 5 | 4 | 5 | 5 |
| Example 8 | SIR | Two | PVA | Glyoxal borate | 3.8 | Present | 3 | 3 | 5 | 3 |

TABLE 1-continued

| | | | | | | | | | | |
|---|---|---|---|---|---|---|---|---|---|---|
| Example 9 | SIR | Two | PVA | Glyoxal borate | 3.8 | Present | 4 | 4 | 5 | 3 |
| Example 10 | SBR | One | PVA | Glyoxal borate | 3.8 | Present | 4 | 4 | 5 | 3 |
| Example 11 | Urethane | One | PVA | Glyoxal borate | 3.8 | Present | 3 | 3 | 4 | 3 |
| Example 12 | Urethane | One | PVA | Adipic acid dihydrazide and oxazole | 3.8 | Present | 3 | 3 | 3 | 3 |
| Example 13 | — | — | Modified PVA | Glyoxal borate | 3.8 | None | 4 | 3 | 5 | 5 |
| Example 14 | — | — | Modified PVA | — | 3.8 | None | 4 | 3 | 5 | 4 |
| Example 15 | SIR | Two | Modified PVA | Glyoxal borate | 3.8 | None | 3 | 4 | 5 | 4 |
| Example 16 | SIR | Two | PVA | Glyoxal borate | 3.8 | None | 3 | 3 | 5 | 4 |
| Example 17 | SIR | Two | PVA | Glyoxal borate | 3.8 | None | 4 | 3 | 5 | 3 |
| Example 18 | SBR | One | PVA | Glyoxal borate | 3.8 | None | 4 | 3 | 5 | 3 |
| Example 19 | — | — | PVA | Glyoxal borate | 3.8 | None | 3 | 3 | 5 | 3 |
| Example 20 | SBR | One | PVA | Glyoxal borate | 3.8 | None | 3 | 4 | 5 | 3 |
| Comparative Example 1 | Urethane | One | PVA | Adipic acid dihydrazide and oxazole | 3.8 | None | 2 | 4 | 1 | 5 |
| Comparative Example 2 | Urethane | One | PVA | Adipic acid dihydrazide and oxazole | 3.8 | None | 1 | 4 | 1 | 5 |
| Comparative Example 3 | Urethane | One | PVA | Adipic acid dihydrazide and oxazole | 3.8 | None | 1 | 5 | 1 | 5 |
| Comparative Example 4 | — | — | PVA | Glyoxal borate | 1.6 | None | 5 | 2 | 5 | 5 |
| Comparative Example 5 | SBR | One | PVA | Glyoxal borate | 3.8 | None | 3 | 2 | 5 | 2 |

As shown in Table 1, in the thermosensitive recording materials of examples, the occurrence of image streaks due to continuous printing are suppressed while maintaining high color development efficiency. In addition, in the thermosensitive recording materials of examples, yellowing or adhesion of images are also excellent compared to the thermosensitive recording materials of Comparative Examples.

Examples 21 to 40

Thermosensitive recording materials were produced similarly to Example 1 except that 100 g of the styrene-isoprene latex (SIR; LX464PX manufactured by ZEON CORPORATION) used for preparing a coating liquid for a thermosensitive recording layer in Examples 1 to 20 was replaced with 100 g of the following styrene-isoprene latex, and evaluation was performed. The evaluation results are shown in Table 1.

[Styrene-Isoprene Latex]

PATERACOL 700D (manufactured by DIC CORPORATION, styrene-isoprene copolymer, concentration of solid contents: 40 mass %, Tg 1: 20° C., Tg 2: 55° C.)

As a result of evaluation, the same results as those in Example 1 are obtained, and the occurrence of image streaks due to continuous printing is suppressed while maintaining high color development efficiency. In addition, regarding yellowing or adhesion of images, excellent performances are shown similarly to Example 1 or the like The entire disclosure of JP2015-111763 is incorporated herein by reference.

All kinds of literature, patent applications, and technical standards described in the present specification are incorporated herein by reference to the same extent as a case where the incorporation of each kind of literature, patent application and technical standard is specifically and individually described.

What is claimed is:

1. A thermosensitive recording material comprising, on a support, a thermosensitive recording layer containing a polyvinyl alcohol and a color development component, and a protective layer containing a resin component, in this order from a support side, wherein at least one of the thermosensitive recording layer or the protective layer further contains a styrene-isoprene resin that has two glass transition points.

2. The thermosensitive recording material according to claim 1, wherein the resin component contained in the protective layer contains a polyvinyl alcohol.

3. The thermosensitive recording material according to claim 1, wherein the styrene-isoprene resin has a first glass transition point of 25° C. or lower and a second glass transition point of 50° C. or higher as the two glass transition points.

4. The thermosensitive recording material according to claim 3, wherein a difference obtained by subtracting the first glass transition point from the second glass transition point exceeds 30° C.

5. The thermosensitive recording material according to claim 1, wherein a mass ratio of a structural unit St derived from styrene to a structural unit Ip derived from isoprene in the styrene-isoprene copolymer is 55:45 to 90:10.

6. The thermosensitive recording material according to claim 1, wherein a polyvinyl alcohol contained in at least the protective layer has an acetoacetyl group.

7. The thermosensitive recording material according to claim 1, wherein the styrene-isoprene resin is a copolymer including a structural unit derived from styrene, a structural unit derived from isoprene, and a structural unit derived from acrylic acid or methacrylic acid.

8. The thermosensitive recording material according to claim 1, wherein the color development component includes a first component that develops a color and a second component that causes the first component to develop a color, and at least the first component is encapsulated in a microcapsule.

9. The thermosensitive recording material according to claim 1, wherein the support is a polymer film.

10. The thermosensitive recording material according to claim 1, further comprising at least one interlayer that contains a polyvinyl alcohol, between the thermosensitive recording layer and the protective layer.

11. The thermosensitive recording material according to claim 1, wherein, in each of the thermosensitive recording layer and the protective layer, a gelatin content is less than 10 mass % with respect to a total mass of the layer.

12. A method for manufacturing the thermosensitive recording material according to claim 1, comprising:

forming, on a support, a thermosensitive recording layer that contains a polyvinyl alcohol and a color development component by coating;

further forming, on the thermosensitive recording layer formed on the support, a protective layer that contains a resin component by coating; and subjecting at least the thermosensitive recording layer and the protective layer to heat treatment after the forming of the protective layer, wherein at least one of the thermosensitive recording layer or the protective layer further contains a styrene-isoprene resin that has two glass transition points, and a temperature range of the heat treatment is greater than or equal to a highest glass transition point of the styrene-isoprene resin but less than or equal to a color development temperature of the thermosensitive recording layer.

13. The method for manufacturing a thermosensitive recording material according to claim 12, further comprising controlling humidity of at least the thermosensitive recording layer and the protective layer before the heat treatment but after the forming of the protective layer.

14. The method for manufacturing a thermosensitive recording material according to claim 13, wherein the controlling of humidity is performed under environmental conditions of a temperature of 10° C. to 40° C. and a relative humidity of greater than or equal to 50%.

* * * * *